United States Patent [19]

Fujisake et al.

[11] Patent Number: 5,027,885

[45] Date of Patent: Jul. 2, 1991

[54] INJECTION APPARATUS AND INJECTION CONTROL METHOD FOR HIGH-SPEED THIN PLATE CONTINUOUS CASTING MACHINE

[75] Inventors: Keisuke Fujisake; Hideyuki Misumi; Junichi Nakagawa; Akira Hashimoto, all of Ohita; Hidetoshi Yuyama; Noriyuki Kanai, both of Oita; Katsuhiro Maeda, Ohita; Tsuyoshi Okada, Ohita; Azumi Inaba, Ohita; Shigeki Kashio, Ohita; Atsuhiro Tokuda, Ohita; Shiro Sukenari, Ohita; Michiaki Kikunaga, Ohita, all of Japan

[73] Assignee: Nippon-Steel Corporation, Tokyo, Japan

[21] Appl. No.: 459,822

[22] PCT Filed: May 16, 1989

[86] PCT No.: PCT/JP89/00493

§ 371 Date: Jan. 16, 1990

§ 102(e) Date: Jan. 16, 1990

[87] PCT Pub. No.: WO89/11362

PCT Pub. Date: Nov. 30, 1989

[30] Foreign Application Priority Data

| | | | |
|---|---|---|---|
| May 16, 1988 | [JP] | Japan | 63-118493 |
| May 16, 1988 | [JP] | Japan | 63-118496 |
| May 19, 1988 | [JP] | Japan | 63-122743 |
| May 20, 1988 | [JP] | Japan | 63-121970 |
| May 20, 1988 | [JP] | Japan | 63-121972 |
| May 28, 1988 | [JP] | Japan | 63-131093 |

[51] Int. Cl.[5] ..... B22D 11/18

[52] U.S. Cl. ..... 164/453; 164/449; 164/500

[58] Field of Search ..... 164/466, 502, 500, 147.1, 164/437, 488, 449, 453

[56] References Cited

U.S. PATENT DOCUMENTS

| | | | |
|---|---|---|---|
| 2,743,492 | 5/1956 | Easton | 164/502 |

FOREIGN PATENT DOCUMENTS

| | | | |
|---|---|---|---|
| 44-17619 | 7/1969 | Japan . | |
| 51-31242 | 9/1976 | Japan . | |
| 52-10646 | 3/1977 | Japan . | |
| 54-128433 | 10/1979 | Japan . | |
| 60-12264 | 1/1985 | Japan . | |
| 60-82255 | 5/1985 | Japan | 164/502 |
| 60-99458 | 8/1985 | Japan . | |
| 61-07146 | 3/1986 | Japan . | |
| 62-52663 | 11/1987 | Japan . | |

*Primary Examiner*—Kuang Y. Lin

*Attorney, Agent, or Firm*—Kenyon & Kenyon

[57] ABSTRACT

An injection apparatus for a high-speed type thin plate continuous casting machine comprises linear motors (3A, 3B) interposing long sides of a flat nozzle (3), a power source unit for applying predetermined currents having a predetermined frequency to the linear motors (3A, 3B), and linear motor power factor improving capacitors (21) connected between the linear motors (3A, 3B) and the power source unit. A material on the inner walls of the short sides of the flat nozzle (3) is a conductive material to improve an edge effect, additionally, the apparatus is constructed to use a heating operation of the linear motor in heating the nozzle or a molten metal in the nozzle by adequately controlling a frequency or a current of a power supplied to the linear motors.

29 Claims, 16 Drawing Sheets

INJECTION APPARATUS AND INJECTION CONTROL METHOD FOR HIGH-SPEED THIN PLATE CONTINUOUS CASTING MACHINE

DESCRIPTION

1. Technical Field

This invention relates to an injection apparatus and an injection rate control method for injecting molten metal into a casting mold in a high-speed type thin plate continuous casting machine which can continuously cast into a thin strand at high speed.

In this type of apparatus, for example, thin steel plates having a thickness of about 40 mm are directly produced from molten steel, so that a process of manufacturing a steel plate can be rationalized. However, it is necessary to pull the strand out at high speed in order to increase the productivity (ton/hour) because the thickness of the strand is so thin.

The present invention relates to an injection apparatus and an injection control method for injecting molten metal into a casting mold in a thin plate continuous casting machine which can cast at high speed.

2. Background Art

Generally, in a continuous casting plant, it is important to keep a molten metal level constant within a casting mold, to stabilize the quality of a stand, especially to stabilize the trace in the surface of the strand, and to prevent the molten metal from overflowing in the casting mold and damage the plant. Therefore, in a conventional continuous casting plant, the molten metal level is controlled by detecting the molten metal level within the casting mold using a molten metal level sensor, such as a sensor utilizing the principle of electromagnetic induction, and adjusting the injection rate by moving a stopper filling a hole provided in bottom of a tundish up or down or by opening or closing a sliding nozzle.

In the aforementioned thin plate continuous casting plant, it is required to raise a pulling-out rate of the stand to five to ten times as much as in a general continuous casting machine to achieve production equal to the general continuous casting machine, because of the small cross section, as mentioned before. In that case, as fluctuation in the molten metal level in the casting mold is frequent and violent, it is required to control the level using an apparatus having quick response.

Therefore, development of a molten metal level detecting means and a injection rate control means which have far quicker response than a molten metal level sensor or injection rate control unit usually used, is required to realize a high-speed type thin plate continuous casting machine to which the present invention relates.

Various molten metal level detecting means having quick response have been proposed (for example, molten metal level detection using a light-sensitive element described in Examined Patent Publication (Kokoku) No. 62-52663 On the other hand, an injection rate control means to which the principle of electromagnetic force is applied, is promising as an injection rate control means having quick response.

Three kinds of systems, i.e., a direct current static magnetic field (electromagnetic brake) system, a current flowing (forced direct current plus direct current static magnetic field) system, and a linear motor (alternating current moving magnetic field) system are known at present. The present inventors grasped various characteristics of the three system through experiments, theoretical calculations, and literature, and compared and examined those characteristics. The present inventors then found that the linear motor is most suitable for the injection apparatus for a thin plate continuous casting machine.

The reason for the selection is as follows. In the direct current static magnetic field system, the molten metal cannot be accelerated and heating characteristics are not sufficient. In the current flowing system, the apparatus is large and complicated, and interferes with the operator's work. Furthermore, there is some anxiety regarding the safety of the system.

Researching prior arts relating to linear motors, Japanese Examined Utility Model Publication No. 44-17619 was found as a publication which discloses an application of a linear motor to a continuous casting machine. The publication discloses a technique where a tundish is divided into two vessels between which a linear motor is arranged to control a molten metal level of the vessel situated above a nozzle. In this system, however, the response is not fast since the molten metal is injected into a costing mold through the vessel situated above the nozzle after its injection rate is controlled by the linear motor.

It is assumed that the reason this configuration was adopted is that if the linear motor was used with the conventional nozzle having a circular cross section, effective control would not be carried out because the efficiency of the electromagnetic force is not sufficient.

Nevertheless, realization of an injection rate control means having quick response is a dream which engineers can not abandon. Japanese Unexamined Patent Publication (Kokai) No. 60-99458 discloses a linear motor used with a conventional (circular) nozzle. In this prior art, a normally conducting coil and a superconducting coil are arranged beside a circular nozzle in an arrangement where fluxes of the coils do not interfere with each other, to increase the electromagnetic force. However there are problems in the prior art that the length of the nozzle has to be long, and maintaining a very low temperature (below 4° K. in metal, below 100° K. in ceramics) to maintain the superconductive state is difficult.

Therefore, the application of the linear motor to the thin plate continuous casting machine seems to still remain at the stage of being only an idea. The basis of this inference is that the fact that success in utilization has not been reported yet and no information that exploitation of this approach is progressing is known. In a word, the goal in applying a linear motor to an injection apparatus for a thin plate continuous casting machine is the development of a practical linear motor unit. The first problem to be examined is an improvement in the efficiency of the electromagnetic force acting on the molten metal.

If the efficiency is improved, the size of the linear motor and its power consumption can be reduced. As a result, the length of the injection nozzle can be shortened, so that the production yield of the nozzle is improved.

Examining ways of improving the efficiency of the electromagnetic force from theoretical calculations and repeated experiments, the present inventors acquired the following knowledge:

A. The efficiency is raised when the width of the gap between the linear motors arranged beside the injection nozzle is reduced.

B. The efficiency is raised when the distance between the inner walls of the nozzle along the direction of the width of the linear motors is enlarged to reduce the influence of the edge effect which is an electromagnetic phenomenon.

As a result of the present inventors acquiring the above knowledge, it was found to be most preferable that the injection nozzle used with the linear motors should have a flat or rectangular cross section, the distance between the pair of linear motors is reduced to reach the length of the short sides of the flat nozzle, and the linear motors should be arranged so as to align the direction of the resulting edge effect with the direction of the long sides of the flat nozzle.

On the other hand, although not described for use with linear motors, a so-called flat nozzle having a flat or rectangular cross section is disclosed in Japanese Unexamined Patent Publication (Kokai) No. 60-12264.

However, several problems still remain in the case where a combination of the aforementioned flat nozzle and linear motors is applied to the thin plate continuous casting machine. The first problem is power consumption. Since the flat nozzle is required to have a strength, the flat nozzle must have a sufficient thickness. Therefore, the distance between the linear motor and the molten steel in the nozzle, namely, the gap, is large so that reactive power is large due to a large leakage reactance.

The second problem is the edge effect. Distribution of the electromagnetic force is not uniform along the direction of the long side, namely, the direction perpendicular to both direction of the magnetic field and the direction of injecting the molten metal. The electromagnetic force is maximum at the center part and extremely reduced at the edge part. Therefore, the molten metal flow near the edge part cannot be sufficiently controlled at present.

Additionally, the linear motor not only has the effect of the electromagnetic force but also has an effect of heating It is anticipated to utilize this effect in the continuous casting plant.

The present inventors investigated the aforementioned first problem, that is, the problem of power consumption. As a result of the investigation it was found that reducing the reactive power improves the power factor, and that it is most preferable to arrange a power factor improving capacitor near the linear motor as a measure to achieve that improvement. Accordingly, when applying the linear motor to the injection apparatus for a thin plate continuous casting machine, the flat nozzle and the power factor improving capacitor may be necessary elements.

In order to control the force of the linear motor acting on the molten metal, current or voltage is mainly controlled, keeping the frequency constant so as to maintain the effect of the power factor improving capacitor. However, if the frequency has to be altered, it is preferable to alter the capacitance of the power factor improving capacitor depending on the frequency.

Regarding the second problem of the edge effect, the present inventors solved this problem by devising a flat nozzle as described later However, this device is not necessary, but only preferable in construction.

Furthermore, the present inventors found that the following two methods are adequate for simultaneously generating the acting force and the heating effect of the linear motor.

The first method is deciding the frequency and the current (or voltage) of the supplied power to the linear motor according to a specific condition, in the case where the acting force and the heating by the linear motor are applied to the molten metal. In this case, the capacitance of the power factor improving capacitor is varied by switching.

The second method is superimposing a plurality of powers having different frequencies as the power applied to the linear motor. This method is described later in detail.

DISCLOSURE OF THE INVENTION

Accordingly, it is a primary object of the present invention to provide a practical injection apparatus for a high-speed type thin plate continuous casting machine, comprising a linear motor arranged close to a flat nozzle, which can solve the aforementioned problems to control an injection rate at high efficiency and with quick response and which consumes little electric power.

Additionally, it is a secondary object of the present invention to provide an injection apparatus for a high-speed type thin plate continuous casting machine, which effectively utilizes the heating effect of the linear motor.

It is another object o the present invention to provide a control method of an injection rate of a molten metal in the aforementioned injection apparatus.

The primary object is carried out by an injection apparatus for a high-speed type thin plate continuous casting machine wherein a molten metal is injected into a casting mold from a tundish through a flat nozzle having long sides in a Y-direction longer than short sides in an X-direction and elongated along a Z-direction, characterized in that the injection apparatus comprises:

linear motors, positioned between the long sides of the flat nozzle for generating an electromagnetic feed force in a z direction along the long sides;

a power source unit for applying predetermined voltages or currents having a predetermined frequency to the linear motors to cause the linear motors to generate an electromagnetic feed force; and linear motor power factor improving capacitors connected to an electric line between the power source unit and the linear motors.

It is preferable that the apparatus further comprises power control means inserted between the power source unit and the linear motors, for controlling at least one of the voltages and currents supplied to the linear motors to control a Z direction acceleration/deceleration force acting on the molten metal in the flat nozzle.

It is also preferable that the inner walls of the flat nozzle in the short side essentially consist of a conductive material which is durable against the molten metal.

The secondary object is carried out by an injection apparatus further comprising:

a temperature detecting means for detecting a temperature of the molten steel, a calculation unit for calculating a heat quantity Q supplied to the molten steel by the linear motors and a force P from the linear motors acting or the molten steel from the signal of the temperature detecting means, and further calculating a frequency f and a current i using a formula $$f=K_1(Q/P)$$

and $$i = K_2(\sqrt{P^2/Q})$$

wherein $K_1$ and $K_2$ are constants, and a power converting unit for converting commercial power to a power having a frequency f and a current i according to the output of the calculation unit and supplying the power to the linear motors.

Another object of the present invention is carried out by a method wherein at least one of a voltage and current supplied to the linear motors is adjusted to control the injection rate from the flat nozzle to the casting mode in the aforementioned apparatus.

BEST MODE FOR CARRYING OUT THE INVENTION

Figure 1:
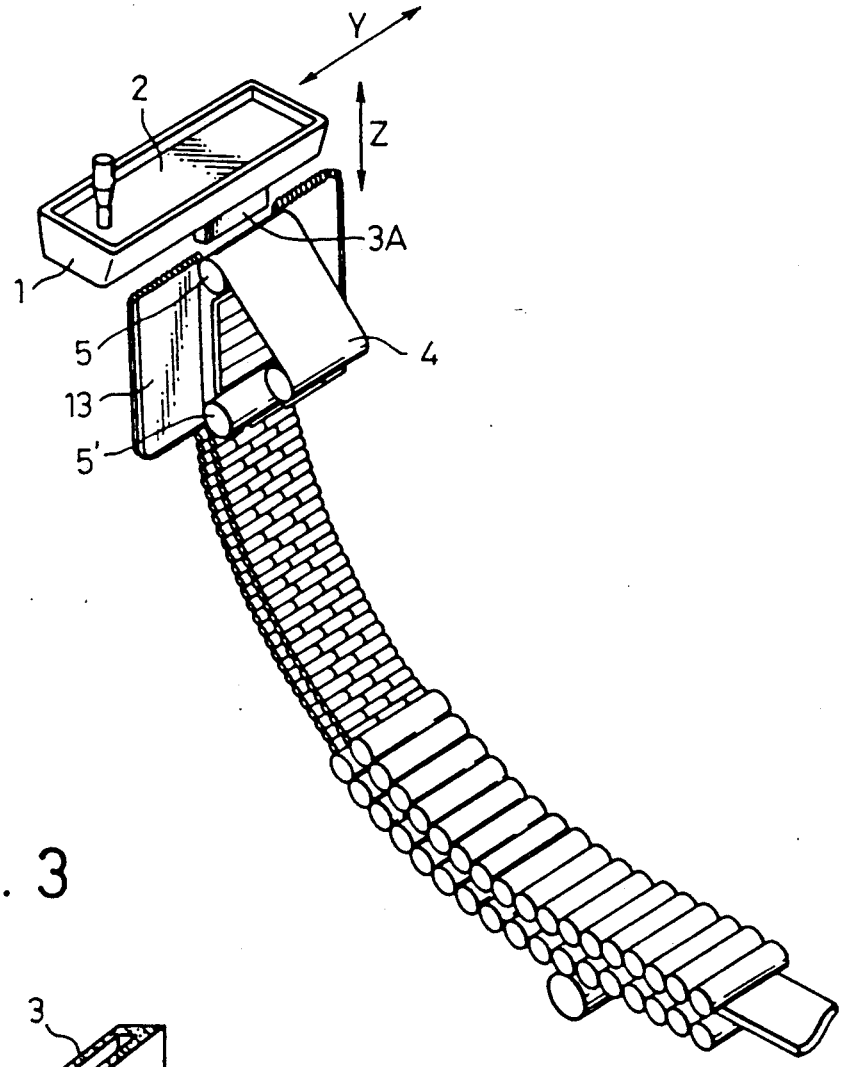
FIG. 1 is a diagram showing an outer appearance of a whole vertical thin plate continuous casting machine according to the present invention.
Figure 2:
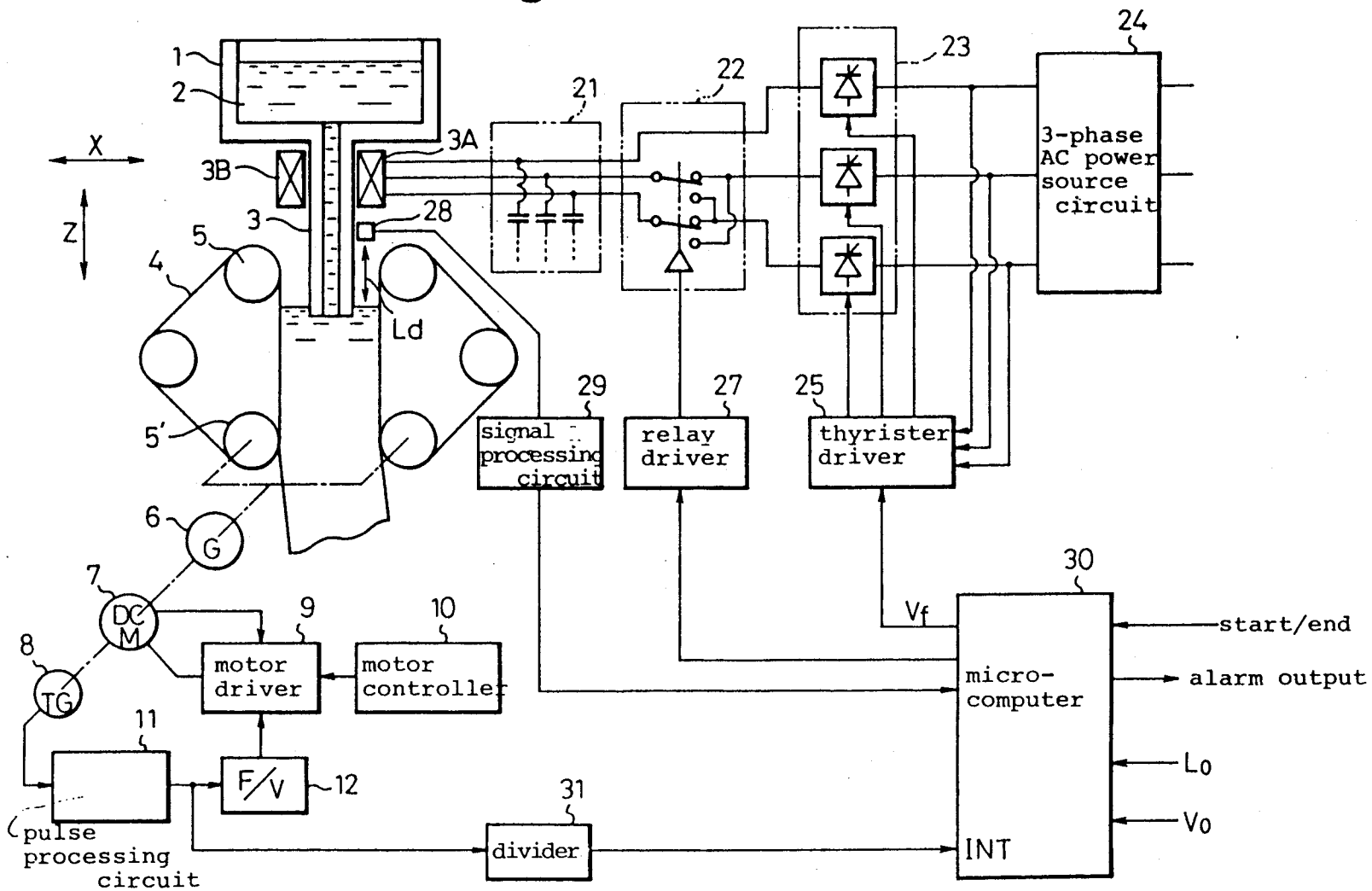
FIG. 2 is a diagram showing a first embodiment of an injection apparatus according to the present invention.

FIG. 1 is a schematic diagram representing an entire thin plate continuous casting machine, to which the present invention is applied, and FIG. 2 is a diagram representing the construction of an injection apparatus according to the present invention.

A molten metal 2 in a tundish 1 is injected into a casting mold through a flat nozzle 3 having a rectangular cross section having a small width in an X direction and a large width in a Y direction perpendicular to the X direction.

In this embodiment, the casting mold is a dual belt type casting mold constituted by two casting belts 4 (only the forward casting belt is shown in FIG. 1) opposite to each other to interpose the nozzle 3, and two movable short sides 13 opposite to each other to interpose the nozzle. Each belt 4 has a width larger than the width (Y direction) of the long side of the flat nozzle 3. The short side 13 has a width larger than the width (X direction) of the short side of the flat nozzle 3.

The short side 13 is described in detail in Japanese Patent Application Nos. 62-328080 and 62-328082.

In all examples of the injection apparatus according to the present invention, the longitudinal direction (Z direction) of the flat nozzle 3 is designed to be vertical. Thus, the flow rate can be larger than designed to be inclined, so that it become easy to smoothly control by a linear motor by filling the nozzle with the molten metal. Additionally, a stopper or a sliding nozzle (not shown) to adjust the injection rate of the molten metal is provided.

The casting belts 4 are suspended and supported by driving rollers 5, 5'. The driving rollers 5, 5' are driven by a DC motor 7 through a reduction gear mechanism 6 at a predetermined speed. A designation speed generator (pulse generator or tachogenerator) 8 is connected to the motor 7. For example, in the case of the pulse generator, it generates a pulsed voltage having a frequency proportional to the speed of the motor 7. This pulsed voltage is converted by a pulse processing circuit 11 into a pulse signal having a frequency proportional to the frequency generated by the pulse generator and a predetermined pulse amplitude and width. An F/V converter 12 generates a voltage (speed voltage) having a level proportional to the above frequency. The motor driver 9 controls an armature current on the basis of a target speed (voltage) supplied from the motor controller 10, the feedback speed (voltage) applied from the F/V converter 12, and the armature current (torque) of the motor 7 so that the actual speed of the motor 7 reaches the target speed. The motor 7 is then rotated at the target speed designated by the motor controller 10. That is, the belts 4 are driven at the target speed.

Figure 3:
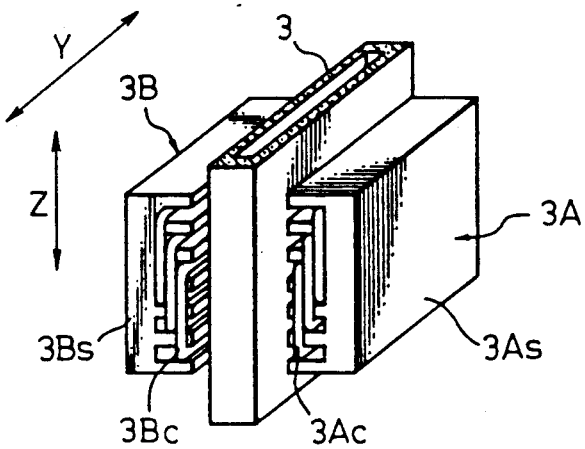
FIG. 3 is an enlarged view of a flat nozzle and linear motors.

A pair of linear motors 3A and 3B are arranged to interpose the long sides (Y direction) of the flat nozzle 3. The relationship between the linear motors and the flat nozzle 3 is shown in FIG. 3.

The linear motors 3A and 3B have a shape wherein a stator of a 3-phase star-connected induction motor is developed on a plane. The respective phase coils are stored in slots between magnetic poles opposite to the rotor (molten steel in the nozzle 3). When 3-phase AC components having a predetermined phase relationship are applied to the phase coils, an upward electromagnetic feed force (deceleration force) in the Z direction is generated in the molten steel. When the AC voltage components applied to the two phase electric coils are reversed, a downward electromagnetic force (acceleration force) in the Z direction is generated in the molten steel in the nozzle 3.

Figure 4:
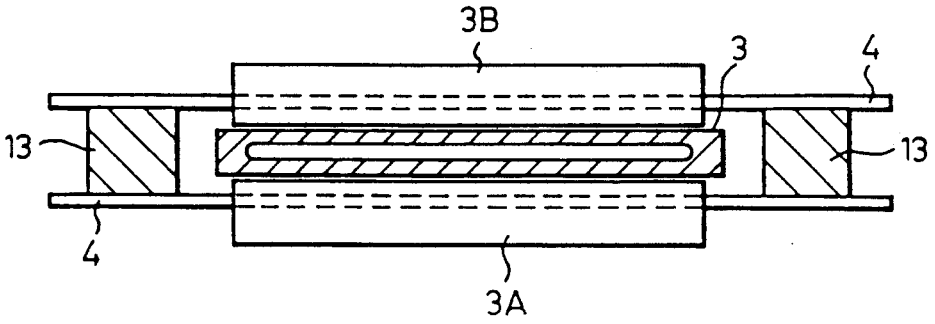
FIG. 4 is a cross-sectional view of an apparatus formed by modulating the apparatus shown in FIG. 2.
Figure 5:
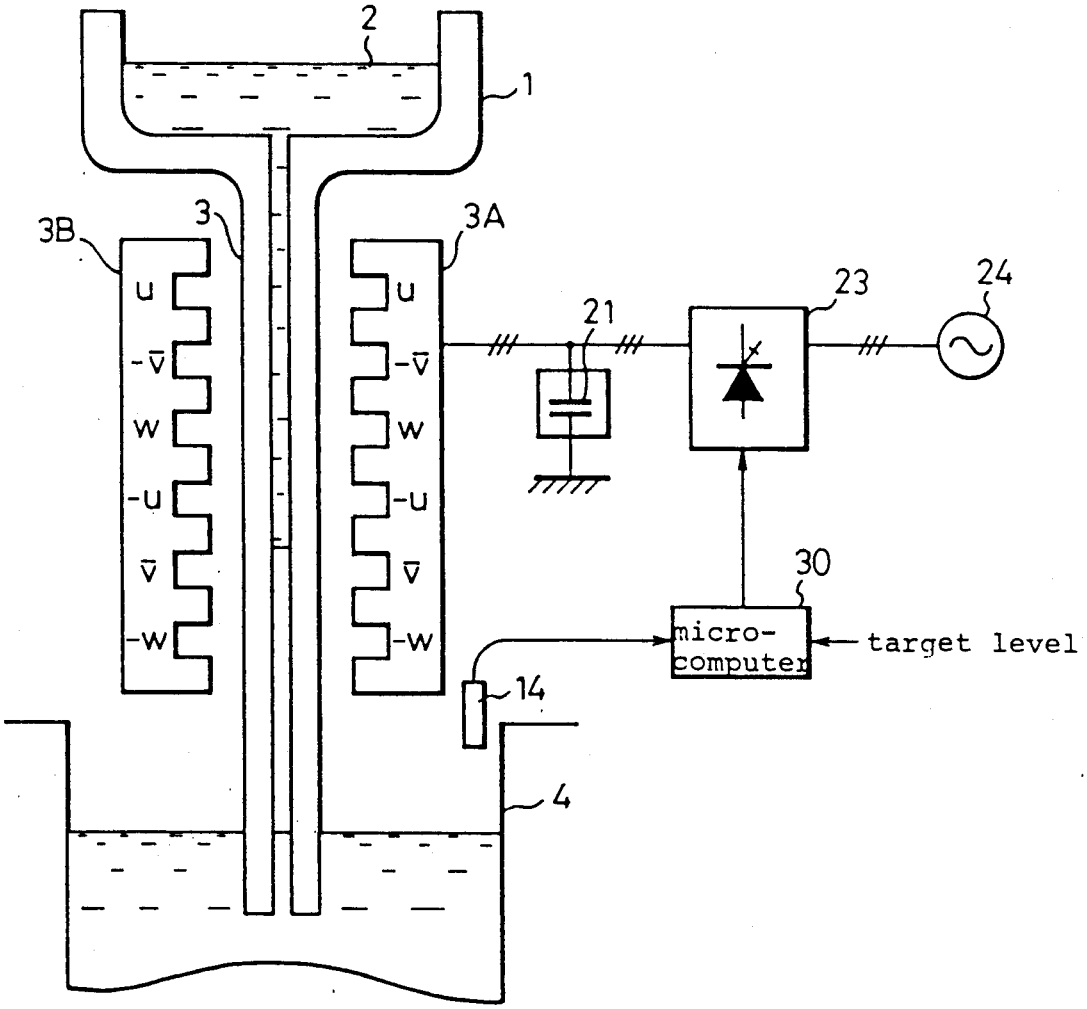
FIG. 5 is a longitudinal sectional view of an apparatus formed by another modulation of the apparatus shown in FIG. 2.

FIG. 4 is a diagram representing in detail a cross section by cutting-off an apparatus formed by modulating the apparatus shown in FIG. 2, at the center of the linear motor 3A and 3B with a plane perpendicular to the Z-direction. FIG. 5 is a cross section of an apparatus formed by modulating the apparatus shown in FIG. 2, similarly to FIG. 2. The state of windings belonging to the respective phase is shown in detail in FIG. 5. The same reference numerals as used in FIG. 1 to FIG. 3 are used in FIG. 4 and FIG. 5 for constituents which are similar to those in FIG. 1 to FIG. 3.

Returning to FIG. 1 to FIG. 3, the phase coils of the linear motors 3A and 3B are connected to the respective phase output lines of a 3-phase AC power source circuit 24 through a thyristor inverter 23 for controlling bidirectional conduction and a phase order switching circuit 22 in units of lines. The thyristor inverter 23 is turned on in response to an ON trigger pulse from a thyristor driver 25 at positive half cycles of the AC voltage to apply the respective AC phase voltages to the linear motors 3A and 3B, and is turned off at zero-crossing points of the AC voltage.

Power factor improving capacitors 21 are connected to connecting lines between the respective phase coils of the linear motors 3A and 3B and the respective phase lines of the 3-phase AC voltage components to reduce the aforementioned reactive power. In this embodiment, since the frequency of the 3-phase AC voltage preferably falls within the range of 100 to 500 Hz to minimize eddy current loss in the molten steel in the nozzle 3, this frequency is set to 120 Hz. That is, the 3-phase AC power source circuit 24 outputs 120-Hz AC voltage components having 120° phase differences to the respective 3-phase output lines. The total power of the linear motors 3A and 3B is 2,800 kVA at 120 Hz. The capacitors 21 have a power of 2,800 kVA accordingly. In a conventional arrangement, the required power of the inverter 23 is 2,800 kVA. However, according to the present invention, connections of the capacitors 21 greatly reduce the power of the inverter 23 to 1,200 kVA, thereby additionally reducing the power source equipment cost.

Thus a linear motor having the power factor improving capacitors has such a high efficiency that the capacity of the power source can be reduced, however there is a factor which must be considered in using the capacitors. This is the fact that as the efficiency is altered when the frequency of the voltage supplied to the linear motor is altered, the frequency must fall within a narrow range.

Accordingly, there are two way to control the output power of the linear motor. One is controlling current and/or voltage while the frequency is fixed, and the other is altering the capacitance of the power factor improving capacitors through change-over switches to alter the frequency. The inventors employed the former approach based on their discoveries and consider that the latter approach should be used only in the special case where both current and frequency must be altered at the same time, as mentioned later.

A video camera 28 is arranged below the linear motor 3A to detect the molten steel level (the distance from the video camera 28 to the molten steel surface) $L_d$. The video camera 28 picks up an image of a portion of the movable short side 13 which is in contact with the molten steel surface. The video signal from the video camera 28 is supplied to the signal processing circuit 29. The signal processing circuit 29 extracts the boundary (i.e., the high-temperature color portion on the image obtained by picking up the image of the inner surface of the movable short side) between the molten steel surface and the movable short side. The extracted boundary is determined whether to be located at an upper or lower position on the screen, and the distance $L_d$ is calculated. Data representing the distance $L_d$ is supplied to the microcomputer (referred to as the MPU hereinafter) 30. The MPU 30 receives the start/end signal, the data representing the target injection rate (speed in the nozzle 3) $V_O$, and the target level $L_O$ (target value of the distance from the video camera 28 to the molten steel) from a host computer or operation panel (not shown). The pulse obtained by frequency-dividing the speed pulse (i.e., the output pulse from the pulse processing circuit 11) is supplied from the frequency divider 31 to the MPU 30.

The MPU 30 calculates a difference dL between the target level $L_O$ and the detection level $L_d$ supplied from the signal processing circuit 29 and then calculates the speed $V_i$ of the molten steel injected into the casting mold so as to nullify the difference dL. The MPU 30 also calculates linear motor energization current values for obtaining the speed $V_i$, and converts the calculated result into an ON angle (i.e., a phase angle to make an ON state) of the thyristor converter 23. The MPU 30 then supplies voltage data $V_f$ representing the ON angle to the thyristor driver 25. The thyristor driver 25 generates a voltage gradually increased in proportion to an increase in AC voltage phase by using zero-crossing points as reference points. This voltage is compared with the analog voltage $V_f$. When the voltage from the thyristor driver 25 reaches the analog voltage $V_f$, the thyristor driver 25 generates a trigger pulse. The trigger pulse is supplied to the gate of the thyristor of the converter 23. Upon reception of this trigger pulse, the thyristor is turned on and then turned off at the next zero-crossing point.

Figure 6A:
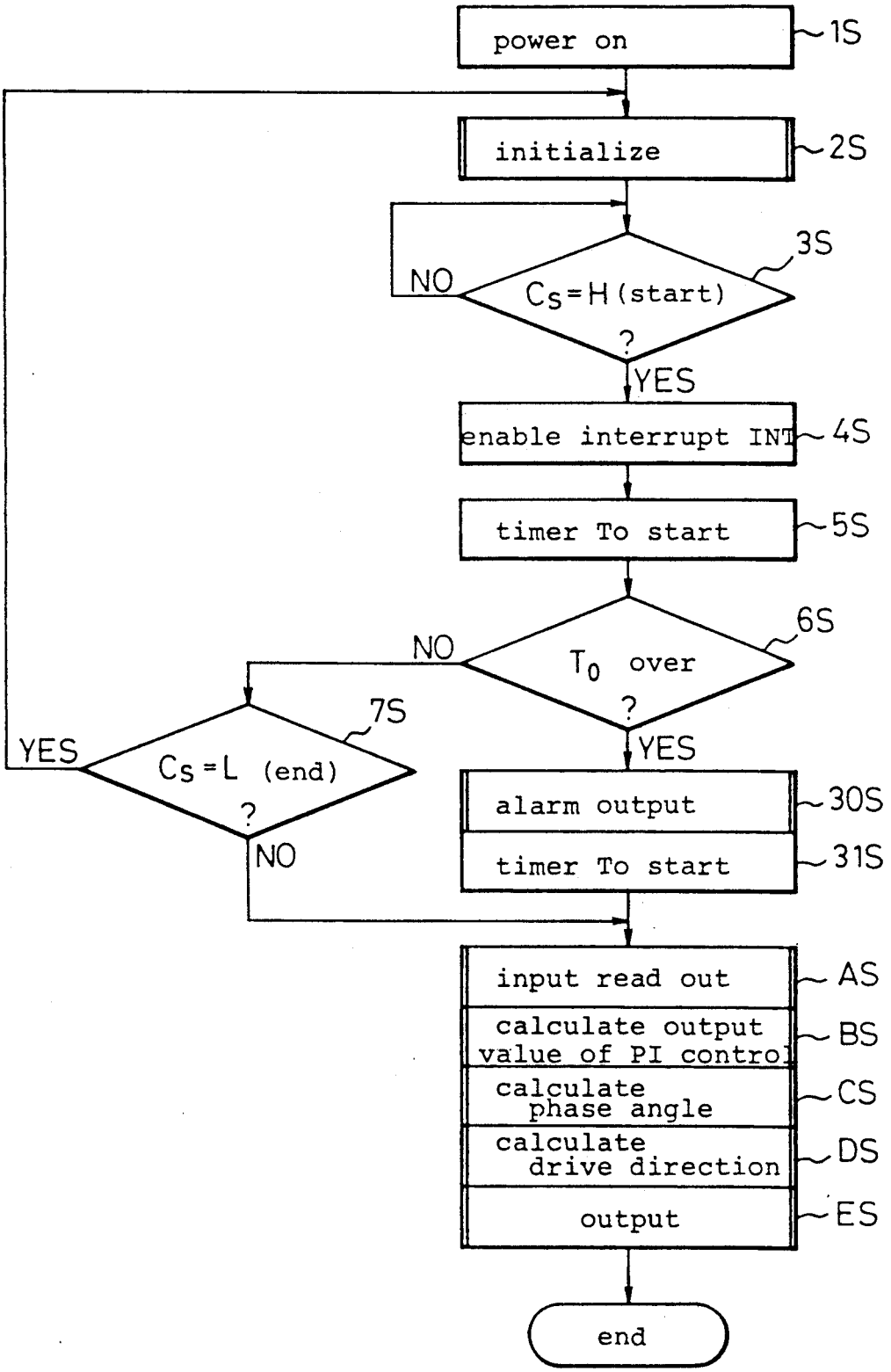
FIG. 6*a* and 6*b* is a flow chart showing a process in microcomputer 30 in the apparatus shown in FIG. 2.
Figure 6B:
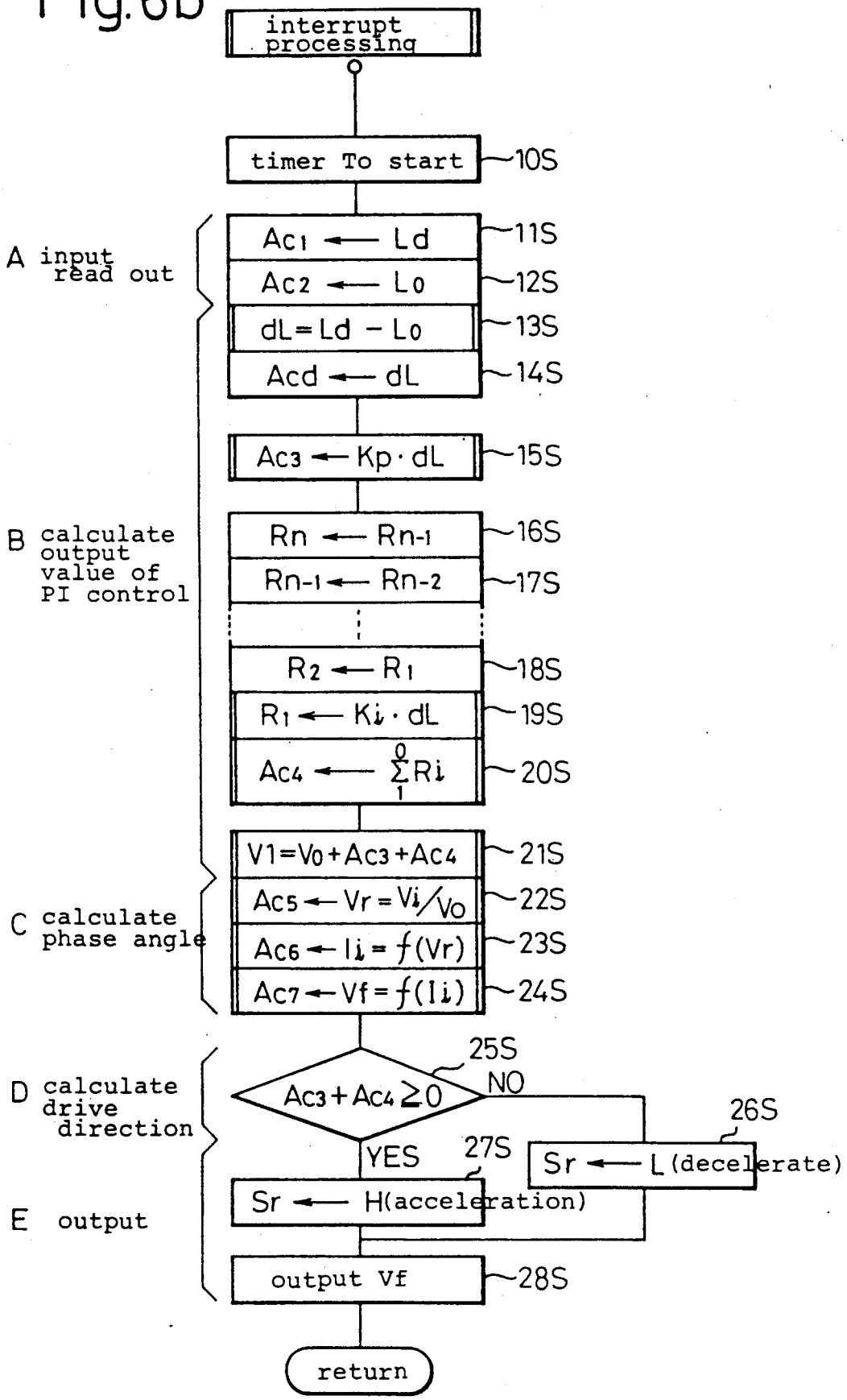

FIGS. 6*a* and 6*b* show control operations of the MPU 30. First, the operations will be described with reference to FIG. 6*a*. When a power switch is turned on (step 1s: the term "step" is omitted within the parentheses hereinafter), the MPU 30 sets the input/output ports in the standby signal level and clears the internal registers, a counter, a timer, and the like. The MPU 30 sends a "ready" signal to the host computer or operation panel. The CPU 30 then waits until control data (data for determining control parameters such as operation constants and timing constants) and a start signal. When the control data are sent to the MPU 30, it fetches these data and writes them in predetermined registers (internal RAM) (2S and 3S).

When the start signal reaches the MPU 30, the MPU 30 enables an interrupt INT (4S), and causes a timer TO (i.e., a program timer for counting the time interval TO) to start. The MPU 30 waits for a time-out of the timer TO (5S and 6S).

When the interrupt INT is enabled, the MPU 30 executes interrupt processing shown in FIG. 6b every time the frequency divider 31 generates one pulse, and this operation will be described below. When one pulse is generated by the frequency divider 31, the timer $T_O$ is started (restarted) (10S), the MPU 30 reads the molten steel detection level Ld and the molten steel target level $L_O$ (11S and 12S). The MPU 30 then calculates the difference dL, and the calculated value is stored in a register $A_{cd}$ (13S and 14S). The difference dL is multiplied by a proportional constant $K_p$, and the product is stored in a register $A_{c3}$ (15S). Data in accumulation registers $R_1$ to $R_n$ are shifted to eliminate the oldest data ($R_n$) so that the data of the register $R_{n-1}$ is stored in the register $R_n$, and the data of the register $R_{n-2}$ is stored in the register $R_{n-1}$ (16S to 18S). A product obtained by multiplying the difference dL by an integral constant $K_i$ is stored in the empty register $R_1$ (19S). A summation (i.e., an integral amount of the correction value) of the data of the registers $R_1$ to $R_n$ is obtained and written in a register $A_{c4}$ (20S). The molten steel speed $V_i$ in the nozzle 3 as a PI control output value is calculated (21S). The ratio $V_r$ of the predetermined speed $V_i$ to the target speed (proportional to the casting target rate) $V_O$ in the nozzle 3 is calculated, and the calculated result is stored in a register $A_{c5}$ (22S). Linear motor current data $I_i$ corresponding to the ratio $V_r$ is read out from the data table which is prestored in the internal memory, and the readout data is stored in a register $A_{c6}$ (23S). The ON phase angle data $V_f$ for producing the current $I_i$ is read out from the data table prestored in the internal memory, and the readout data is stored in a register $A_{c7}$ (24S). The MPU determines whether the data (correction value with respect to the target speed $V_O$) stored in the register $A_{c4}$ is positive or negative (25S), i.e., whether the linear motors are to be accelerated or decelerated. If the data is determined to be positive (acceleration), an H output is supplied to the relay driver 27 (27S). The relay contact of the phase order switching circuit 22 is driven downward, and the linear motors 3A and 3B are connected to the inverter 23 so as to achieve acceleration (i.e., downward driving in the Z direction). If the data is determined to be negative (deceleration), an L output is sent to the relay driver 27 (26S). The relay contact of the phase order switching circuit 22 is located at the position shown in FIG. 2. In this state, the linear motors 3A and 3B are connected to the inverter 23 to achieve deceleration (i.e., upward driving in the Z direction). The MPU 30 updates the data $V_f$ of the register $A_{c7}$, and the updated data is supplied to the thyristor driver 25 (28S). As described above, the driving direction and force of the linear motors 3A and 3B are corrected in correspondence with the detection value $L_d$.

The above interrupt processing is performed every time the frequency divider 31 generates one pulse. An integral value of the differences obtained in previous n interrupt operations is stored in the register $A_{c4}$.

The time interval $T_O$ of the timer $T_O$ is slightly longer than a period $T_m$ of a pulse generated by the frequency divider 31 when the continuous casting machine shown in FIG. 1 is set at a designed minimum speed. Therefore, when the DC motor 7, the tachogenerator 8, the pulse processing circuit 11, and the frequency divider 31 are normally operated, a pulse is generated by the frequency divider 31 before the time-out of the timer $T_O$. The time-out of the timer $T_O$ does not occur. Therefore, the interrupt processing shown in FIG. 6b is repeatedly performed in a normal state.

When no pulse is generated by the frequency divider 31 during the time interval $T_O$ due to some abnormality, interrupt processing (FIG. 6b) is not executed, and the time-out of the timer $T_O$ occurs. The MPU 30 advances from step 6 to step 30 in FIG. 6a and sends an alarm signal to the host computer or operation panel (30S). The timer $T_O$ is started (restarted) (31S), and the MPU 30 performs an input read operation (S), a PI control output value calculation (S), a phase angle calculation (S), a driving direction calculation (S), and an output operation (S). The MPU 30 terminates a series of operation. The contents of the operations (AS to ES) are the same as those of steps 11 to 28 in FIG. 6b.

The PI control sampling period is determined by a pulse generated by the frequency divider 31 so as to inverse-proportionally shorten the sampling period when the casting rate is high.

When an end signal is received from the host computer or operation panel to the apparatus (7S), the MPU 30 is advanced to step A, carries out the aforementioned steps, and is terminated, i.e., set in a standby state (the linear motors are stopped).

Figure 7A:
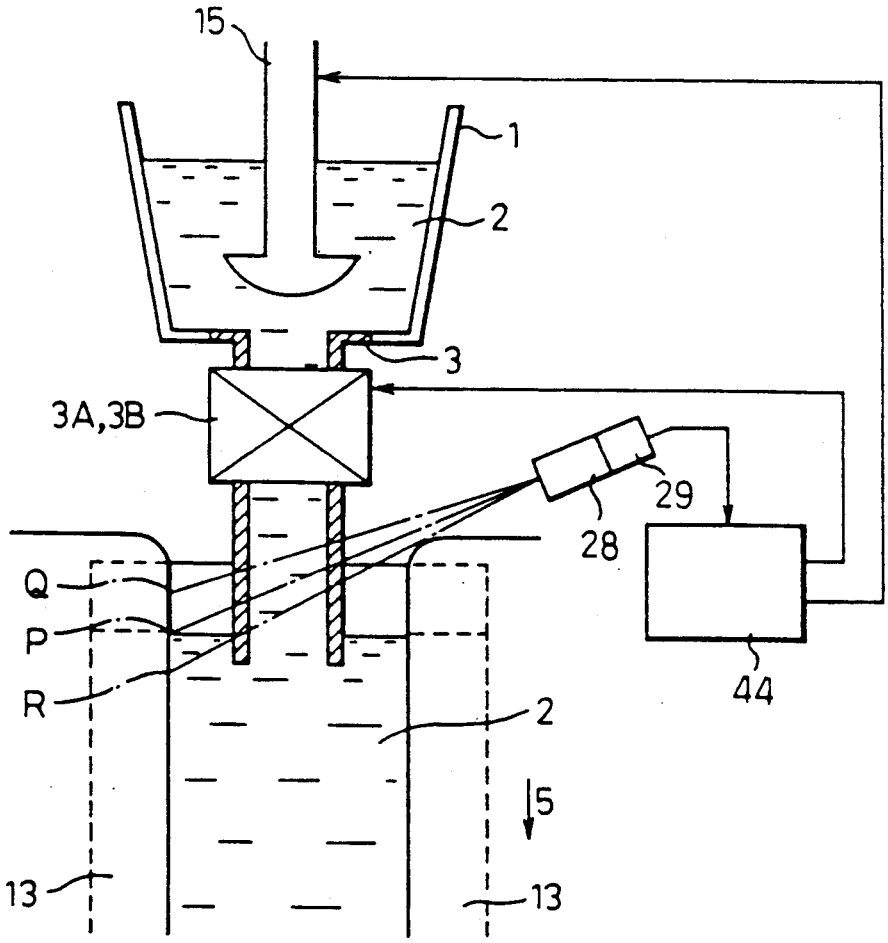
FIG. 7A is a diagram representing a second embodiment of the injection apparatus according to the present invention.
Figure 7B:
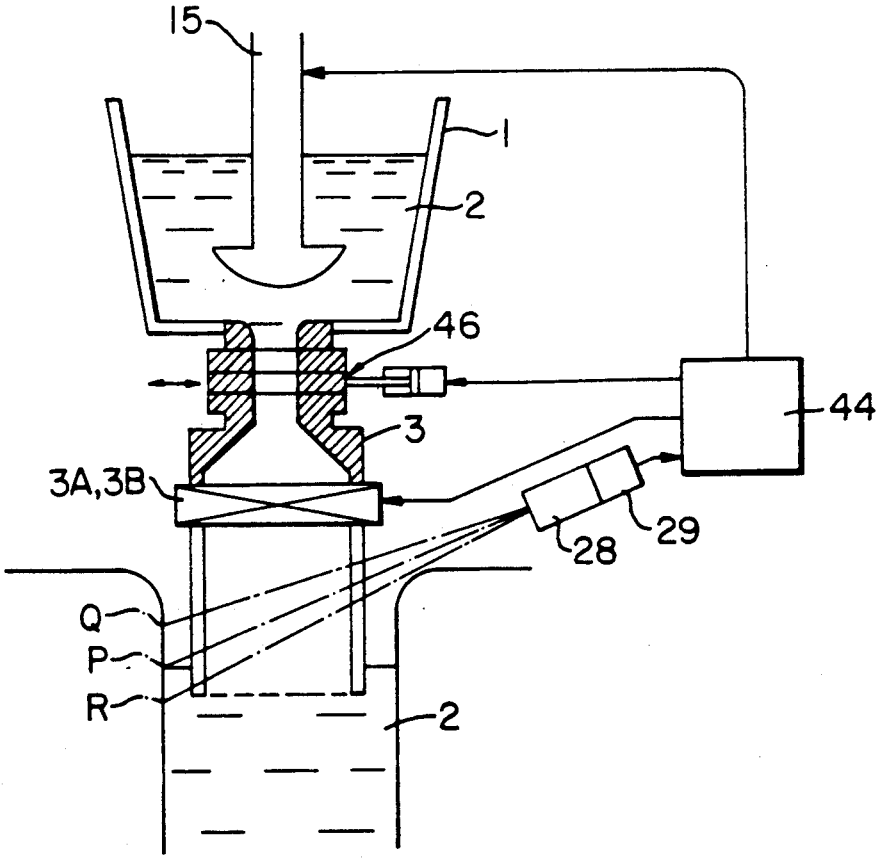
FIG. 7B is a detailed diagram of the embodiment illustrated in FIG. 7A showing a sliding nozzle.

FIG. 7 is a Y direction sectional view of an injection nozzle representing a second embodiment of the apparatus according to the present invention.

Reference numeral 13' denotes short-side members of a casting mold. Metal belts 4 are spaced apart from each other by, e.g., a thin steel plate with a thickness of about 40 mm between the upper and lower surfaces of the drawing sheet of FIG. 7, and are driven in parallel to each other at high speed in a direction indicated by an arrow 50.

A point P in FIG. 7 indicates a molten steel surface position on a costing mold wall surface (a position corresponding to the aforementioned $L_O$). The molten steel surface position serves as a target in operation. Points Q and R indicate allowable upper and lower limits of the molten steel surface position in operation, respectively.

A molten steel position detection end according to the present invention is constituted by an industrial television camera 28. The industrial television camera 28 is installed to photograph images within the range of the positions Q to R. Only one industrial television camera 28 is installed in FIG. 7. However, a plurality of television cameras may be installed. The inner wall of the short-side of the casting mold which opposes the television camera is used as an object to be photographed in FIG. 7. However, a conventional optical means may be used, and other inner walls may serve as the objects. Since a portion near the molten steel surface is exposed to high temperatures and there is a lot of dust at the portion near the molten steel surface, a molten steel surface detection end located near the molten steel surface may often be damaged or its detection precision may often be degraded. The television camera can precisely detect the molten steel position even if it is installed away from the molten steel surface. With this lay out, the television camera is rarely damaged. In continuous casting for a thin steel plate, the gap between the long sides of the casting mold is very narrow, as previously mentioned. The industrial television camera is suitable for detection of the molten steel surface position within this gap. Light emission from the molten steel can be detected by other photosensitive elements (CCD elements, etc.). However, the same visible image as the object can be obtained by the industrial television camera. Therefore, the operations for adjusting the direction of the detection end so as to be aligned with the object in prealignment can be facilitated.

Reference numeral 44 in FIG. 7 denotes a control unit. The television camera is aligned so that the half of the image of the molten steel surface at, e.g., the point P is bright on the industrial television camera, the entire image at the point Q is bright, and the entire image at the point R is dark. The signal processing unit 29 converts these images into signals. The signals are supplied to the control unit 44 and the output signals of the control unit 44 are supplied to the linear motor 3A and 3B and a stopper 15 (in detail stopper control unit; not shown).

An injection flow supplied from the nozzle 14 is free from disturbance because the nozzle 14 extending near or below the molten metal surface is used.

The apparatus of the present invention further comprises a stopper 15 capable of closing the molten steel injection nozzle in response to the signal from the control unit 44. As previously described, a large number of traveling and pivotal components are used in the continuous casting machine for a thin steel plate. For example, when the metal belts 4 stops traveling due to a failure, a unit is required to quickly and accurately stop molten steel injection so as to prevent the molten steel from overflowing from the upper portion of the casting mold. Although the linear motor 3A and 3B is suitable for controlling the injection rate of the molten steel, it is not suitable for perfectly stopping the injection flow since a high static pressure of the molten metal in the tundish 1 acts on the nozzle 14, and also due to existing edge effect. For example, when the metal belts 4 stops, the molten steel surface becomes higher than the position Q. According to the present invention, when the molten steel surface position exceeds a dangerous range, the stopper 15 is operated in response to the signal from the control unit 44 to stop the injection flow. When a casting accident caused by the overflow of the molten steel from the upper portion of the casting mold occurs, its repair is cumbersome. According to the present invention, this accident can be prevented by the stopper unit 15.

The stopper 15 may have a similar construction to that used in a conventional continuous casting plant to control an injection pate. A sliding nozzle used for the same purpose as the stopper in a conventional continuous casting plant can be used for the aforementioned purpose. The sliding nozzle is not shown in the figures because it is well known to those skilled in the art.

The stopper 15 or the sliding nozzle can be used for an emergency stop when the molten steel level exceeds an upper limit as mentioned above. In addition, control with the linear motors and control with either the stopper 15 or sliding nozzle can be used together to realize a system where both controls compensate each other to realize only the merits of both controls. Namely, the control with the linear motors has an excellent quality of quick response, but it cannot stop the injection completely though a remarkable improvement is obtained according to the present invention. On the other hand, the stopper or the sliding nozzle has a slow response, but has a wide control range including a completely stopped state.

Accordingly, if control with the linear motors is carried out when the difference between the target molten metal level and the detected actual molten metal level is smaller than a predetermined level, and control with the stopper or the sliding nozzle is carried when the difference becomes larger than the predetermined level, then a control which has quick response and a wide control range including a completely stopped state can be realized.

Figure 20:
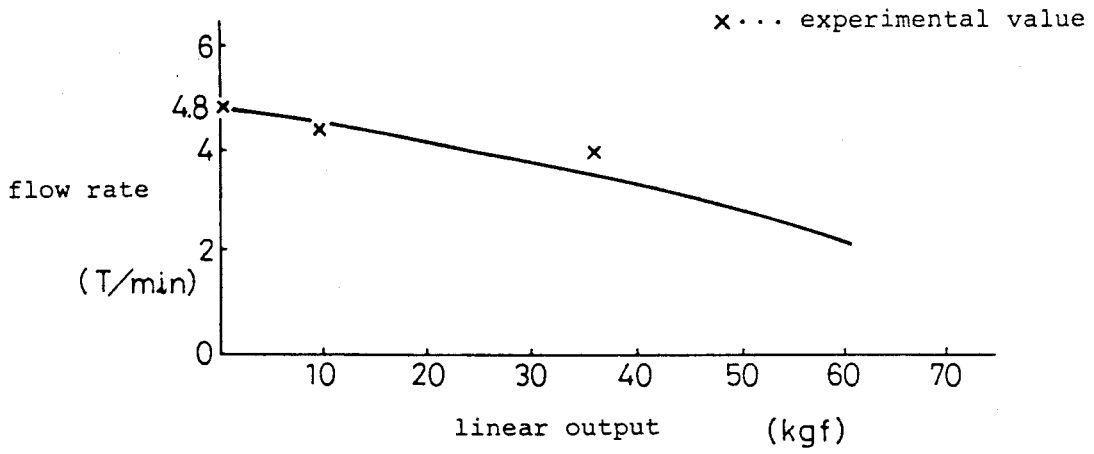
FIG. 20 is a diagram representing an experimental result of flow rate control in the injection apparatus according to the present invention.

The predetermined value may be determined within the range where the injection nozzle can endure an elevated force of the linear motors, as shown in FIG. 20. Though the greater predetermined value is suitable for controlling the molten metal level, it causes a higher degree of danger of damage of the injection nozzle. Therefore, the value must be determined considering a balance of both factors.

In the case where the predetermined value is high, control of the molten metal level is usually carried out by operating the linear motors, and the stopper or the sliding nozzle only serves to completely stop the injection. Though the linear motors can stop the injection, the stopped state is not stable. Therefore, a stopped state over a long time interval should be performed with the stopper or the sliding nozzle. If the predetermined value is very small, function of the linear motors becomes ineffective. Accordingly, it is preferable that employment of the linear motors be decided considering molten metal level fluctuation characteristics and the characteristics of the linear motors shown in FIG. 20.

Figure 8:
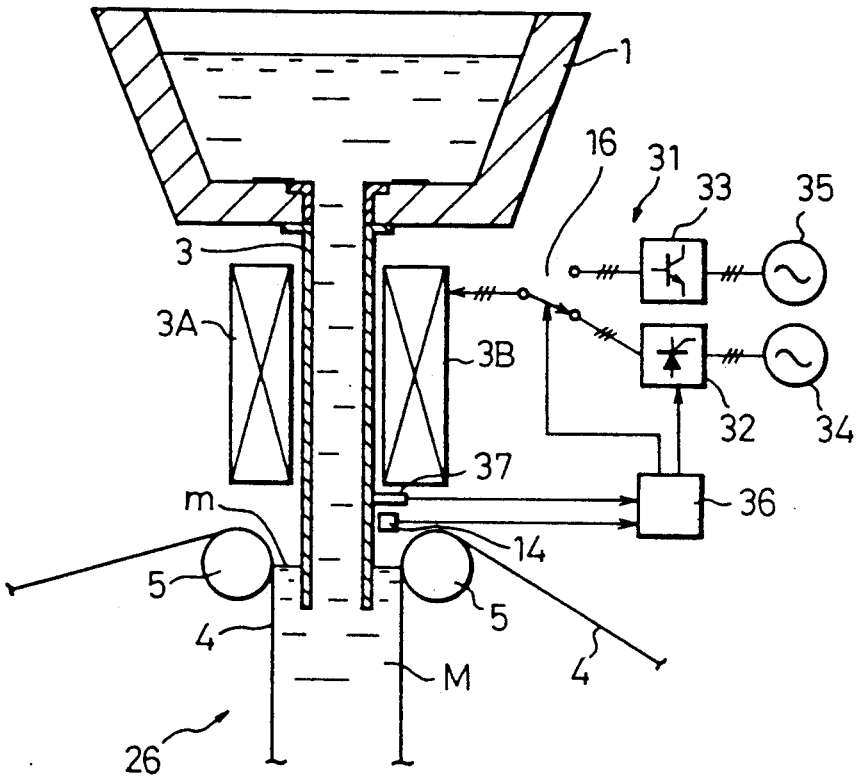
FIG. 8 is a diagram representing a third embodiment of the injection apparatus according to the present invention.

FIG. 8 is a longitudinal sectional view showing a structure of a tundish and a portion near a casting mold in the continuous casting machine to explain a third embodiment of the present invention. FIG. 8 shows a state during casting.

Referring to FIG. 8, an injection nozzle 3 extends from the bottom portion of a tundish 1 to the interior of a casting mold 26. The cross-sectional shape of the injection nozzle 3 and the casting mold 26 is rectangular. The injection nozzle 3 is made of alumina graphite. A pair of linear motors 3A and 3B are arranged to face both wide surfaces of the injection nozzle 3. Each linear motor 3A, 3B has a width large enough to cover the opening of the injection nozzle 3 in the long-side direction of the casting mold 26.

A power supply unit 31 for supplying power to the linear motors 3A and 3B comprises a low-frequency inverter 32, a high-frequency inverter 33, and power sources 34 and 35. The low and high-frequency inverters 32 and 33 are connected to the linear motors 3A and 3B through a switch 16. The low-frequency inverter 32 and the switch 16 are controlled by a control unit 36.

A permeation depth $\delta$ of an electromagnetic field in the conductor is expressed by the following known equation (1)

$$\delta = \sqrt{1/\pi f \sigma u} \qquad (1)$$

where f is the frequency of the power supplied to the linear motor, $\sigma$ is conductivity, and u is permeability.

When the powers of appropriate frequencies f (frequencies of the high- and low-frequency ranges) are supplied to the linear motor in accordance with the conductivities $\sigma$ and the permeabilities $\mu$ of the molten metal and the injection nozzle, the electromagnetic field can be applied to only the injection nozzle or both the molten metal and the injection nozzle. Therefore, control of the injection rate and heating of the injection nozzle can be performed by only the linear motors Since the conductivity of the molten metal is larger than that of the nozzle, the linear motors serve as flow control units for applying a thrust to the molten metal upon reception of the low-frequency power. The windings of the linear motors serve as induction coils for heating the injection nozzle upon reception of a high-frequency power.

Figure 9:
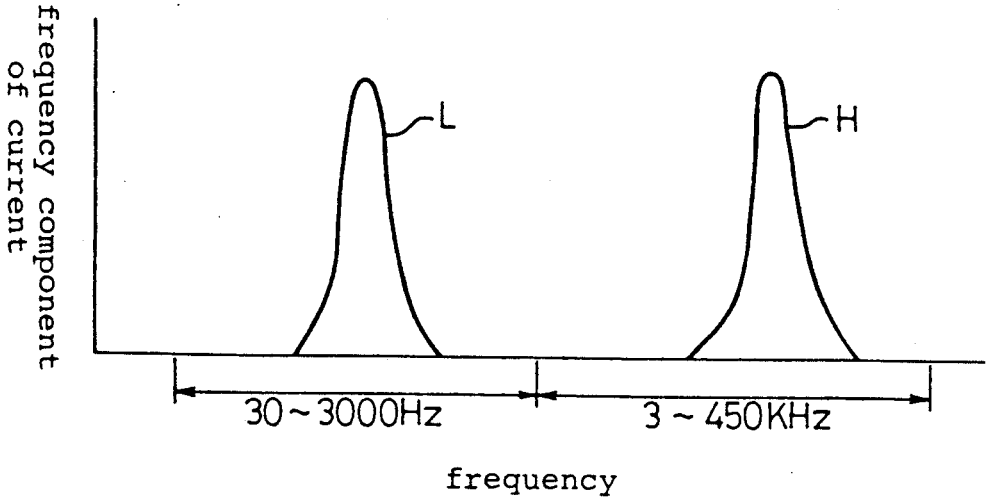
FIG. 9 is a diagram representing a frequency distribution of low-frequency power L and high-frequency power H in the apparatus shown in FIG. 8.
Figure 10:
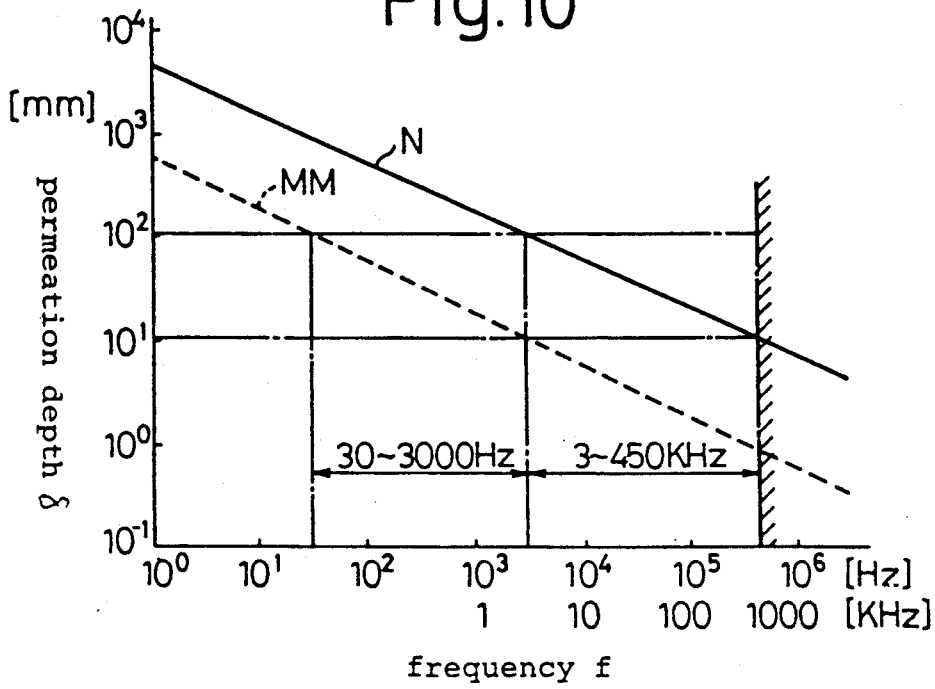
FIG. 10 is a diagram representing a relation between a frequency f of a power and a permeation depth δ.

As shown in FIG. 9, the low-frequency inverter 32 outputs a low-frequency power L, and the high-frequency inverter 33 outputs a high-frequency power H. The frequency of the low-frequency power is selected from the range of 30 to 3,000 Hz, and the frequency of the high-frequency power is selected from the range of 3 to 450 kHz. More specifically, when the relationship between the frequency f and the permeation depth $\sigma$ of the electromagnetic force is obtained on the basis of the conductivities $\sigma$ and permeabilities u of the molten steel and alumina graphite in accordance with equation (1), molten steel M is represented by a line MM in FIG. 10, and alumina graphite is represented by a line N. When the actual thickness of the cast piece and the actual thickness of the injection nozzle 3 are taken into consideration, the permeation depths $\delta$ of the electromagnetic fields for these thickness preferably fall within the range of about 10 to 100 mm. FIG. 10 shows that the frequency ranges corresponding to these permeation depths $\delta$ are 30 to 3,000 Hz for the low-frequency range and 3 to 450 kHz for the high-frequency range.

The technical specifications of the continuous casting machine having the above arrangement are as follows.

Casting mold (slab) sectional area: 600 mm (long side)×50 mm (short side)

Injection nozzle outer dimensions: 300 mm (width)×30 mm (thickness)

No. of nozzles: 1

Injection nozzle outer dimensions: 300 mm (width)×30 mm (thickness)

No of nozzles: 1

Injection nozzle dipping depth: 50 mm

Casting rate: 10 m/min

The technical specifications of the linear motors are as follows.

Outer dimensions: 670 mm (height)×300 mm (width)×230 mm (thickness)

Winding groove dimensions: 80 mm (depth)×10 mm (width)×20 mm (pitch)

Rated low-frequency power: 400 kW at 120 Hz

Rated high-frequency power: 200 kW at 120 Hz

Control of the injection rate and heating of the injection nozzle are performed in the continuous casting machine as follows.

Prior to casting, the switch 16 is switched to the high-frequency inverter 33 to supply a high-frequency current to the windings of the linear motors 3A and 3B, thereby performing induction heating of the injection nozzle 3. At this time, since the injection nozzle is empty, only the injection nozzle 3 is heated. When the injection nozzle 3 is heated to a predetermined temperature, the control unit 36 switches the switch 16 to the low-frequency side in response to a temperature signal from a temperature sensor 37. The molten metal M is supplied from the tundish 1 to the casting mold 26 through the injection nozzle 3.

The molten steel injection rate is changed in accordance with a molten steel head in the tundish 1. When the cast piece S is flat, casting must be performed at a high casting rate and hence a high molten steel injection rate. For this reason, the molten steel heat in the tundish 1 and the molten steel injection rate are abruptly changed during progress of casting, and the molten steel surface level m is changed. However, the molten steel level m must fall within a predetermined range so as to start cooling of the molten steel M from an optimal position in the casting mold 26 and to prevent the molten steel M from overflowing from the casting mold 26. A molten steel surface level detector 14 arranged above the casting mold 26 detects the molten steel surface level m, and a signal therefrom is input to the control unit 36. The control unit 36 instructs an output voltage applied to the low-frequency inverter 32 on the basis of the level signal. As a result the output voltages applied to the linear motors 3A and 3B are controlled, and hence the molten steel level m can be maintained within the predetermined range. Switch 16 is again switched to the high-frequency side when one injection cycle of the molten metal is finished. The injection nozzle and steel adhering to the inner wall of the injection nozzle are heated until the next injection cycle of the molten metal is started. In this way, continuous casting is smoothly started without solidification and adhesion to the inner wall of the injection nozzle when the next cycle injection of the molten metal is started. If the heating effect of the linear motors is not utilized, another means must replace it. However, another means is not known at present.

Figure 11:
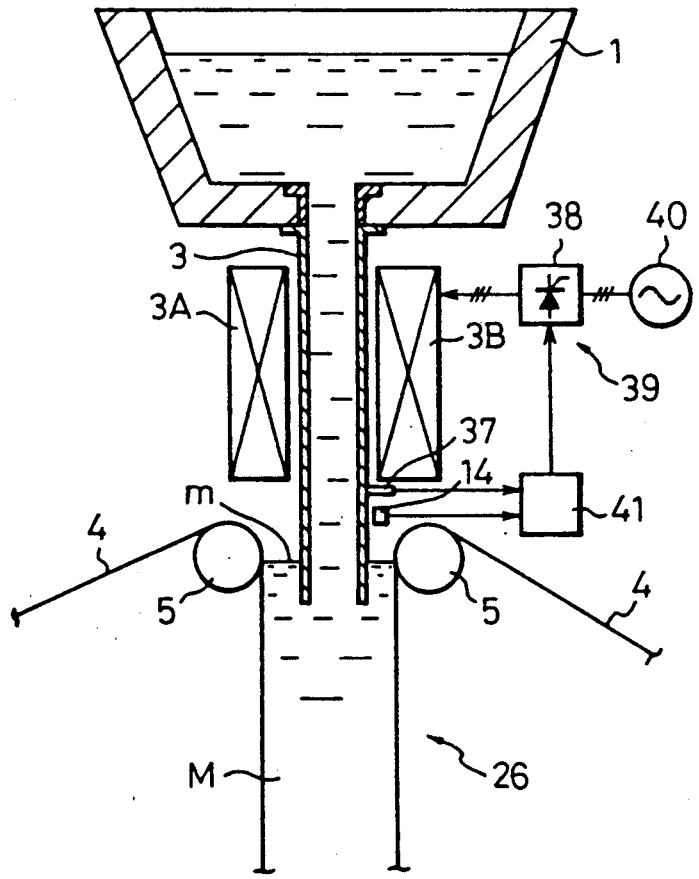
FIG. 11 is a diagram representing a fourth embodiment of the injection apparatus according to the present invention.

FIG. 11 shows a fourth embodiment of the present invention.

In the above embodiment, the two inverters, i.e., the low-frequency inverter 32 and the high-frequency inverter 33 are used to control the injection rate and heat the injection nozzle. In the fourth embodiment, the above operations are performed by one inverter 38.

A power supply unit 39 comprises the inverter 38, a power source 40, and a control unit 41. In order to cause one inverter 38 to generate power having a plurality of frequency components, a pulse-width modulation type inverter is used to output rectangular wave voltages. An output reference signal and a PWM-modulated signal input to the inverter 38 are controlled by the control unit 41, thereby controlling the output voltages and their frequencies. In this embodiment, control of the injection rate and heating of the injection nozzle 3 are simultaneously performed.

Accordingly, it is preferable that the linear motor be used for simultaneous control of injection rate and heating of the injection nozzle during injection of the molten steel, and be used for control of only heating of the injection nozzle before the injection and between the injection. Heating of the nozzle is carried out in order to prevent solidification and adhesion of the molten steel or the like to the inner wall of the nozzle, gradually growing, and finally narrowing the effective cross-sectional area of the nozzle. This is especially effective in continuous casting.

Figure 12:
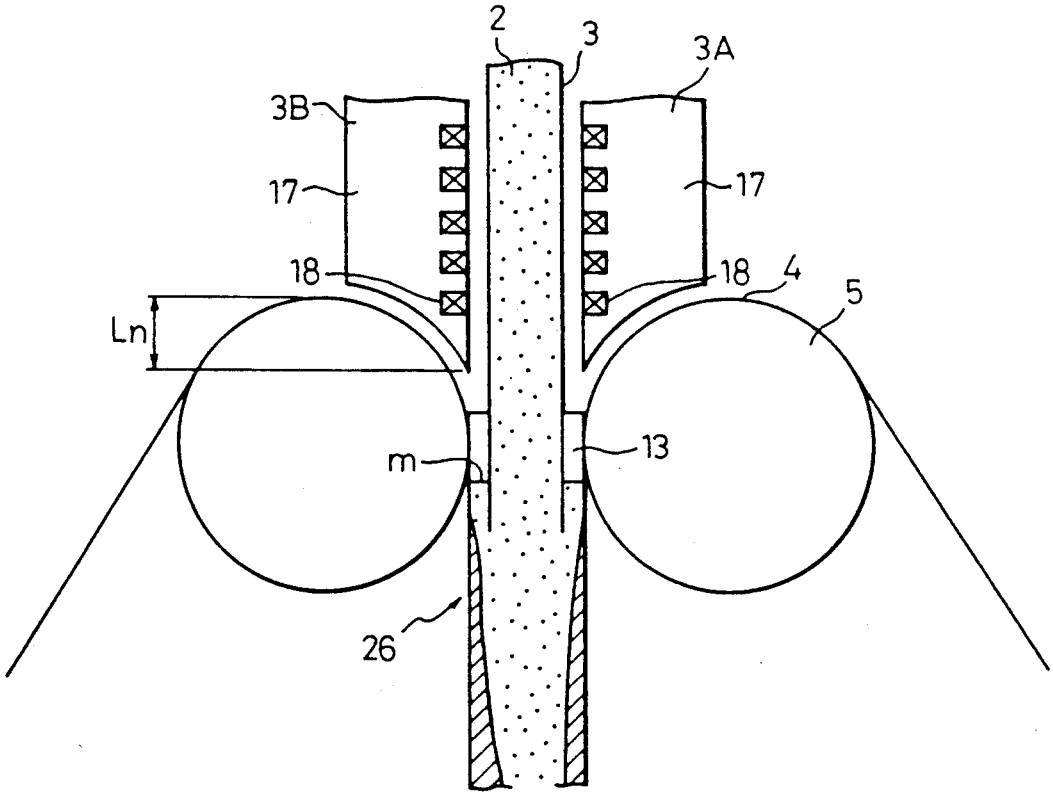
FIG. 12 is a diagram representing a fifth embodiment of the injection apparatus according to the present invention.

FIG. 12 is a schematic side view of a casting mold and its periphery in a continuous casting machine showing a fifth embodiment of the present invention.

As shown in FIG. 12, a flat nozzle 3 extends from the bottom portion of a tundish (not shown) to a molten metal M in a casting mold 26.

One of problems with employing linear motors in the injection unit of a continuous casting machine is that the length of the injection nozzle must be long. But because the injection nozzle is long, the production yield become lower and the nozzle becomes liable to be damaged. The latter problem is serious because the force of the linear motors is added to the pressure of the molten steel, and because if the injection nozzle is damaged the linear motors are also damaged. Therefore, shortening of the injection nozzle as well as miniaturization of the linear motors by improvement of the efficiency and improvement of strength of the injection nozzle, is a main design point.

The casting mold 26 comprises a pair of endless casting belts 4 wound between upstream rollers 5 and downstream rollers (not shown) and a pair of movable short sides 13 arranged at the left and right sides in a widthwise direction so as to oppose each other. The flat casting mold 26 is formed so that the side surfaces of the movable short sides 13 are in contact with the belt surfaces.

A pair of linear motors 3A and 3B are arranged to face both wide surfaces of the flat nozzle 3. An iron core 17 of each linear motor 3A, 3B, has a flat plate-like shape and an adequate width to cover an opening of the flat nozzle 3 with respect to the long-side direction of the casting mold. The iron core 17 has a plurality of grooves horizontally extending to face the corresponding wide surface of the flat nozzle 3. Windings 18 are respectively arranged in the grooves to generate a vertical traveling magnetic field when a current is applied to the linear motor. The lower end of the iron core 17 is notched to extend along the circumferential surface of the corresponding upper roller 5 and is inserted between the flat nozzle 3 and the corresponding upstream roller 5. The windings 18 are arranged in even the lower end portion. A power source is connected to the windings 18 through an inverter (not shown), and an output from the inverter is controlled by a control unit (not shown).

The technical specifications of the dual belt type continuous casting machine having the linear motors with the above arrangement are as follows:

Casting mold (slab) selectional area: 600 mm (long side)×50 mm (short side)

Nozzle outer dimensions: 300 mm (width)×40 mm (thickness)

No. of nozzle: 1

Nozzle dipping depth: 50 mm

Casting rate: 10 m/min

The technical specifications of the linear motor are as follows:

Outer dimensions: 670 mm (height)×300 mm (width)×230 mm (thickness)

Winding groove dimensions: 80 mm (depth)×10 mm (width)×20 mm (pitch)

Lower end portion insertion length L: 200 mm

Rated power: 2,800 kVA at 120 Hz

Pole pitch: 300 mm

Number of poles: 2

When the above linear motor was employed, the length of the flat nozzle could be shorted by 200 mm as compared with the conventional flat nozzle. The effect is remarkable. As a result of casting by the above casting machine, the molten metal surface level could be maintained almost constant.

Next, distribution of an electromagnetic force particularly along the longitudinal direction of the flat nozzle (Y-direction), and the edge effect problem are described.

Figure 13:
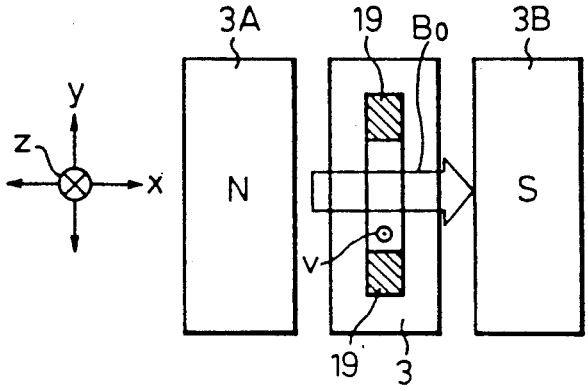
FIG. 13 is a diagram showing a cross section of a flat nozzle in the injection apparatus according to the present invention.

The present inventors repeatedly made extensive studies and experiments except for molten steel surface level control in which linear motors 3A and 3B were arranged opposite to side surfaces of a flat nozzle 3, as shown in FIG. 13 (cross-sectional view). The present inventors confirmed that phased silica and alumina graphite could not set the injection flow rate to zero due to a large edge effect in a refractory injection nozzle. The present inventors tried to analyze this mechanism.

The linear motors 3A and 3B are arranged to oppose both sides surfaces of the injection nozzle 3. As shown in FIG. 13, a magnetic field $B_O$ traveling as a function of time in a direction x of a molten iron flow is applied to a direction y perpendicular to the direction x of the molten iron flow. An electromagnetic force (the left-hand rule) by a vector product between the applied traveling magnetic field and an induction current depending on a traveling speed of the magnetic field $B_O$ and a molten iron flow speed V is applied as an acceleration or deceleration force in the direction x of the molten iron flow. When the electromagnetic force is controlled, the flow rate of the molten iron is changed. In order to change the electromagnetic force, the magnitude of the traveling magnetic field and its traveling speed are changed. Therefore, the magnitude of the traveling magnetic field of the linear motor and the traveling speed of the magnetic field can be controlled by electrical changes at high speed, thereby obtaining excellent response characteristics.

Figure 14A:
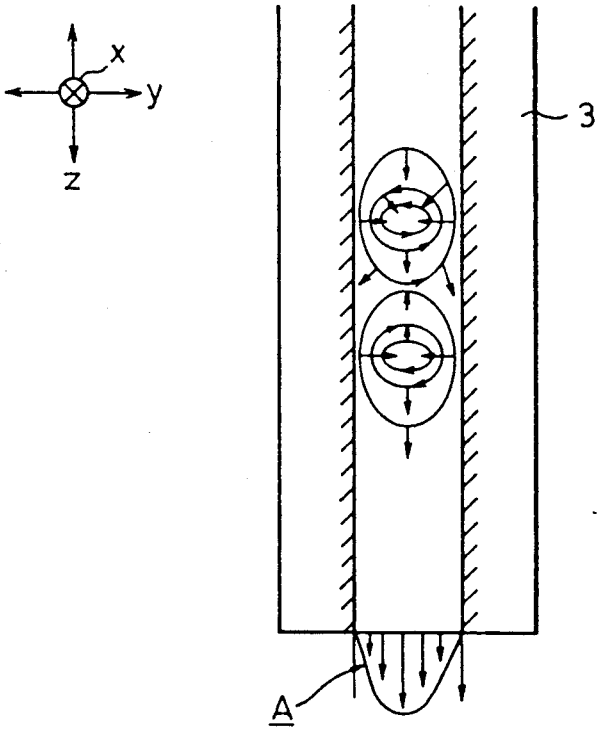
FIG. 14*a* is a diagram for explaining edge effect in the prior art.

When the linear motors 3A and 3B are arranged, as shown in FIG. 13, it is assumed to cause an eddy current to flow, as indicated by a solid line arrow in FIG. 14A. When the left-hand rule is applied to this eddy current, the electromagnetic force acts in a direction perpendicular to the flow direction of the eddy current. The component of the electromagnetic force in the direction x of the molten iron flow is given, as shown in a graph A in FIG. **14*a***. This graph exhibits occurrence of the edge effect (the magnitude at the central portion is large, and that at the edge portion is small).

The present inventors made extensive studies and repeated various experiments. The present inventors found that the edge effect could not be fundamentally solved by an improvement of the linear motors 3A and 3B, and that the structure of the injection nozzle 3 was most preferably replaced with a structure wherein part of the inner walls of the nozzle 3 consisted of a conductive material 19 which was always in contact with the molten iron as shown in FIG. 13.

Figure 14B:
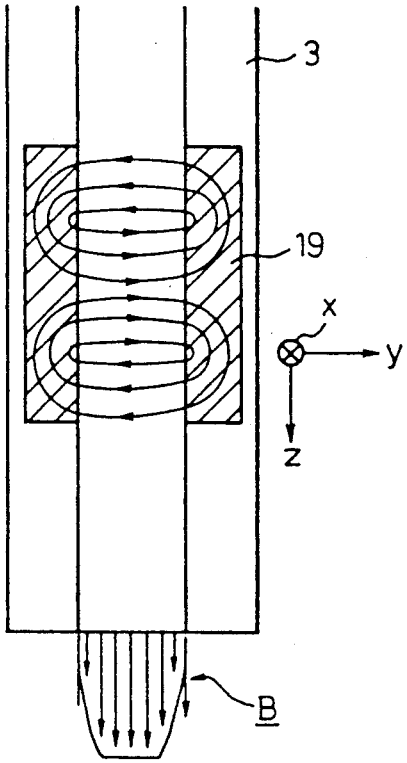
prior art Fig. 14b
FIG. 14*b* is a diagram representing an improvement of the edge effect in the apparatus according to the present invention.

The lines of magnetic force from the linear motors 3A and 3B are directed from the front surface perpendicular to the drawing surfaces of FIGS. **14*a* and 4*b* to the lower surface, and vice versa (i.e., the x direction). When the conductive material 19 is provided to a portion (through which the lines of magnetic force flow) in a direction Y perpendicular to the injection direction Z of the molten iron and the direction x of the lines of magnetic force, i.e., the material 19 is provided to right and left hatched portions of the nozzle 3, as shown in FIG. 14*b*, eddy currents generated in these portions are also generated inside the conductive material 19 to increase the eddy current on the surface of the nozzle. In this case, the direction of eddy current is perpendicular to the surface of the nozzle. As indicated by a solid line arrow in FIG. 14*b*, the distribution is given as an elliptical shape whose major axis is aligned in the horizontal direction. As indicated by a graph B below the ellipses, the molten iron injection (Z) component of the electromagnetic force takes effect, and the electromagnetic force in the surface portion of the nozzle 3** can be increased. Therefore, the edge effect described above can be greatly improved.

The conductivity of the conductive material 19 used on the inner walls of the nozzle 3 is preferably similar to that of the molten iron. According to experiments of the present inventors, it is recommended that the conductivity of the conductive material 19 is 1/10 or more that of the molten iron.

The material for the existing injection nozzle is mainly phased silica or alumina graphite, as described above. Alumina graphite exhibits a conductive property, but cannot have a 1/10 or more conductivity of the molten iron. Phased silica is an insulator.

$ZrB_2$ or carbon is recommended as a conductive material having durability to the molten metal. Carbon can be used with molten iron. The use of the $ZrB_2$ which does not penetrate into the molten steel is preferable in the case of molten steel.

A cast iron plate was inserted into the opposite inner walls in the injection nozzle made of phased silica, and an edge effect test was performed. The edge effect was greatly improved, as expected, and efficiency was also improved. However, when the injection time was prolonged, the cast iron was melted.

The thickness of the conductive material 19 is preferably large on an industrial basis. However, the upper limit value of the thickness is determined by a manufacturing method. The conductive material 19 should be formed at least in portions corresponding to the linear motors 3A and 3B in the vertical direction, when viewed along the longitudinal direction z of the nozzle 3. If the length of the conductive material 19 exceeds the z-direction length of each of the liner motors 3A and 3B, the effect can be sufficiently enhanced. The width of each of the linear motors 3A and 3B is preferably larger than the width of the molten iron when viewed in the widthwise direction Y of the nozzle 3.

According to the results which the inventors obtained by analyzing characteristic formulas relating to linear motors, the acting force P which the linear motor applies to the molten steel and the heat quantity Q supplied from the linear motor to the molten steel, are given as equations (2) and (3) below:

$$P=k_1 \cdot f \cdot i^2 \text{ [kgf/kg]} \quad (2)$$

$$Q=k_2 \cdot f^2 \cdot i^2 \text{ [°C./sec/kg]} \quad (3)$$

where f is the input power frequency [Hz], i is the line current [A], and $k_1$ and $k_2$ are the constants.

Equations (2) and (3) are established in a low-frequency range in which as a diamagnetic field generated by an eddy current flowing through the molten steel is smaller than a magnetic field generated by a current flowing through an induction coil. In the high-frequency range, the force P is not increased unlike an increase in power source capacity caused by an increase in impedance of the linear motor. Therefore, the high-frequency range is not advantageous in use of the linear motor.

Equations (2) and (3) yield equations (4) and (5) below.

$$F=(k_1/k_2)(Q/P) \quad (4)$$

$$i = (\sqrt{k_2/k_1^2})(\sqrt{P^2/Q}) \quad (5)$$

-continued

If $k_1/k_2 = K_1$, and $\sqrt{k_2/k_1^2} = K_2$ are given, equations (4) and (5) can be rewritten as equations (6) and (7)

$$f=k_1 (Q/P) \quad (6)$$

$$i = k_2 (\sqrt{P^2/Q}) \quad (7)$$

where K1 and K2 are the constants.

Figure 15:
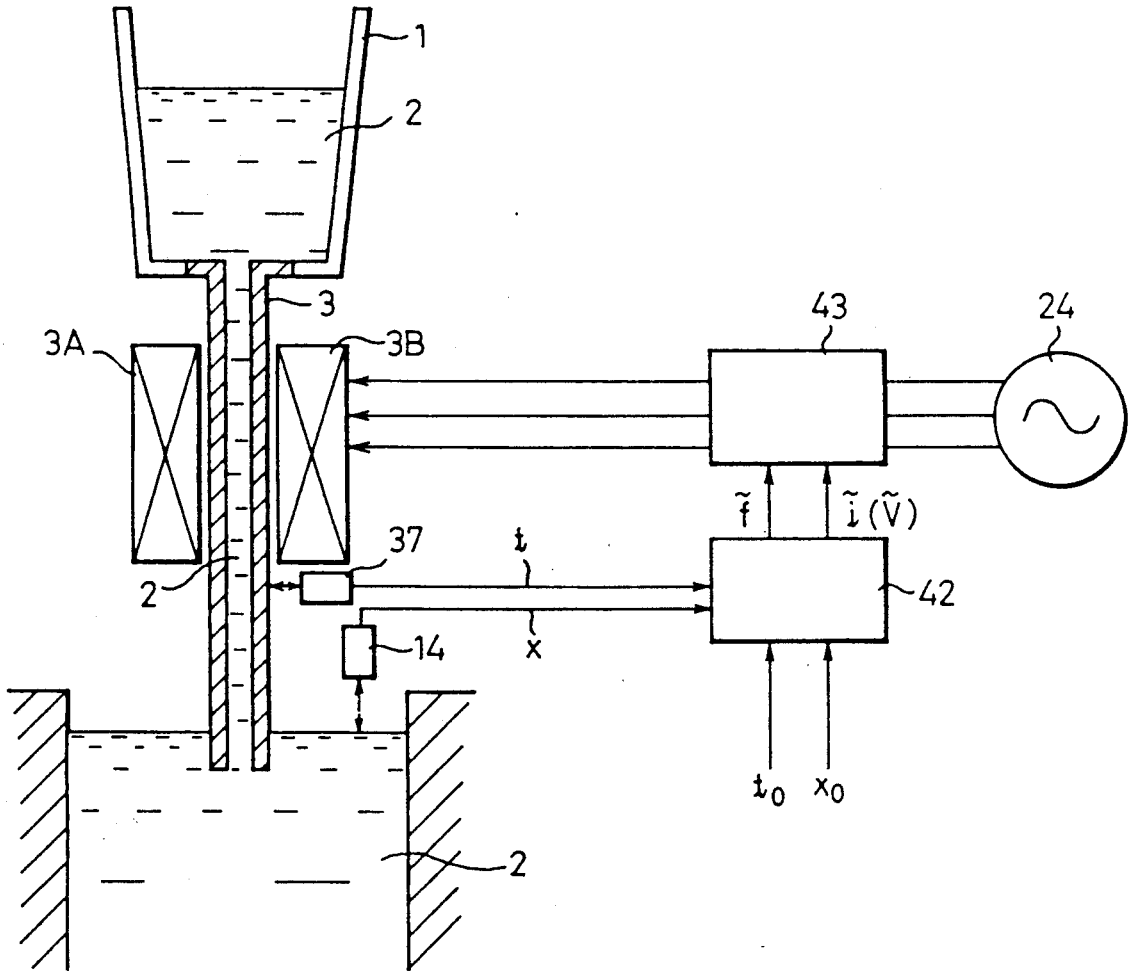
FIG. 15 is a diagram representing a sixth embodiment of the injection apparatus according to the present invention.
Figure 16:
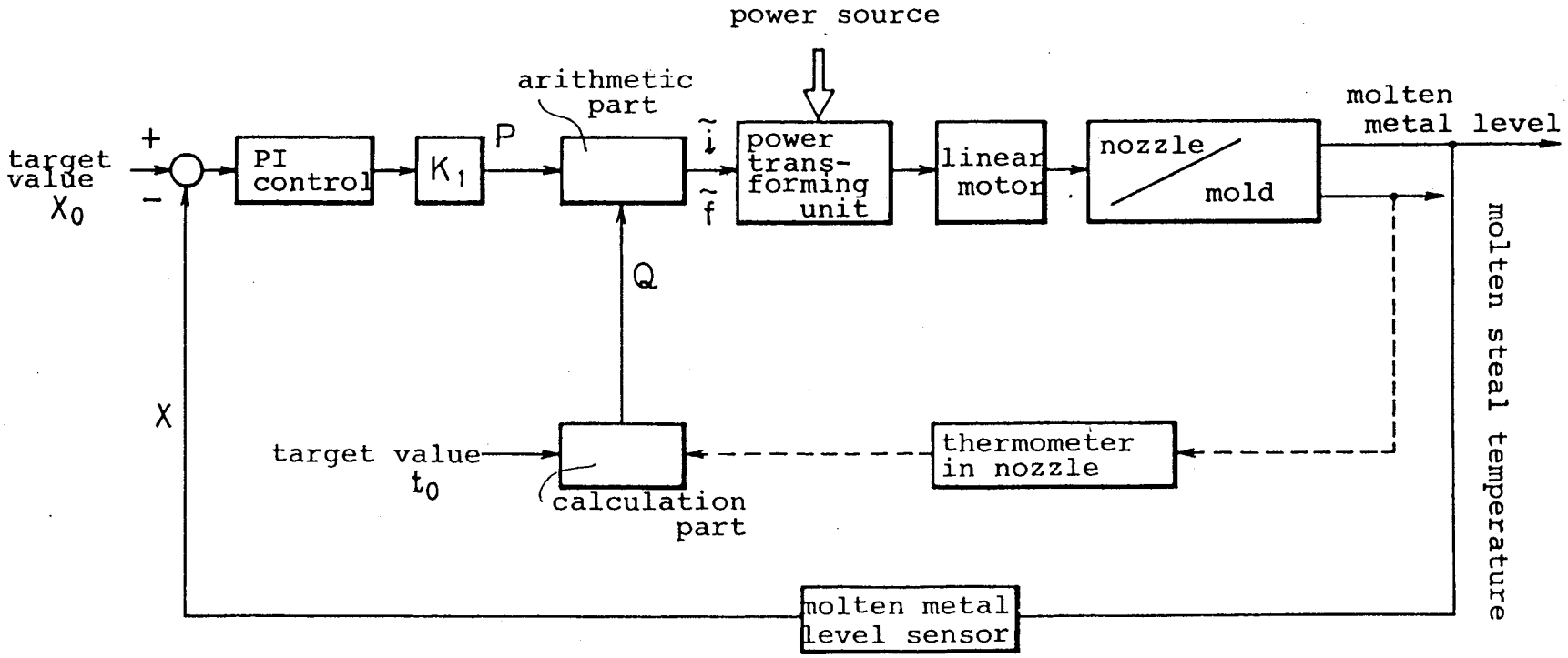
FIG. 16 is a block diagram representing control in the apparatus shown in FIG. 15.

FIG. 15 shows a detailed procedure of a method of simultaneously controlling the injection rate and temperature of the molten steel by using equations (6) and (7), and FIG. 16 is a block diagram representing the control method.

Reference numeral 14 in FIG. 15 denotes a position detection end of the present invention. The position detection end 14 detects a molten steel surface height X in the casting mold. The acting force P which the linear motor applies to the molten steel is changed depending on a difference $(X-X_O)$ between the detected molten steel surface height X and a reference molten steel surface height (an optimal molten steel surface height for operation) $X_O$. The force P is a function of the difference $(X-X_O)$. A relation as a most suitable expression for continuous casting operation is defined as equation (8):

$$P=\psi(X-X_O) \quad (8)$$

Reference numeral 42 in FIG. 15 denotes an arithmetic unit which receives $X_O$ and equation (8) in advance. The molten steel surface height X detected by the position detection end 14 is transmitted to the arithmetic unit 42, and the arithmetic unit 42 calculates PI corresponding to X.

Reference numeral 37 in FIG. 15 denotes a molten steel temperature detection end for detecting a molten steel temperature t. The heat quantity supplied from the linear motor to the molten steel is adjusted in accordance with a difference $(t-t_O)$ between the detected temperature t and a reference molten steel temperature $t_O$. Note that the heat quantity Q is defined as a function of the difference $(t-t_O)$ as follows:

$$Q=\phi(T-t_O) \quad (9)$$

The arithmetic unit 42 of the present invention receives the reference temperature 10 and equation (9) in advance. The actual molten steel temperature t detected by the temperature detection end 37 is transmitted to the arithmetic unit 42, and the arithmetic unit 42 calculates Q1 corresponding to t.

The arithmetic unit 42 of the present invention also receives equations (6) and (7). Therefore, the arithmetic unit 42 calculates a frequency $f_1$ and a current $i_1$ which are to be input to the linear motor as follows:

$$f_1=k_1 (Q_1/P_1)$$

$$i_1 = k_2 (\sqrt{P_1^2/Q_1})$$

Reference numeral 24 in FIG. 15 denotes a commercial power; and 43, a power transforming unit. The arithmetic unit 42 controls the power transforming unit 43 to cause it to transform the commercial power 24 into a power having the frequency $f_1$ and the current $i_1$. The transformed power is supplied to the linear motor, so that the force $P_1$ and the heat quantity $Q_1$ are applied to the molten steel in nozzle 3.

As described above, the force $P_1$ and the heat quantity $Q_1$ are supplied from the linear motors 3A and 3B to the molten steel in accordance with signal from the position detection end 14 and the temperature detection end 37, so that the injection rate and temperature of the molten steel are controlled to recover the reference molten steel surface height $X_O$ and the reference molten steel temperature $t_O$.

Figure 17:
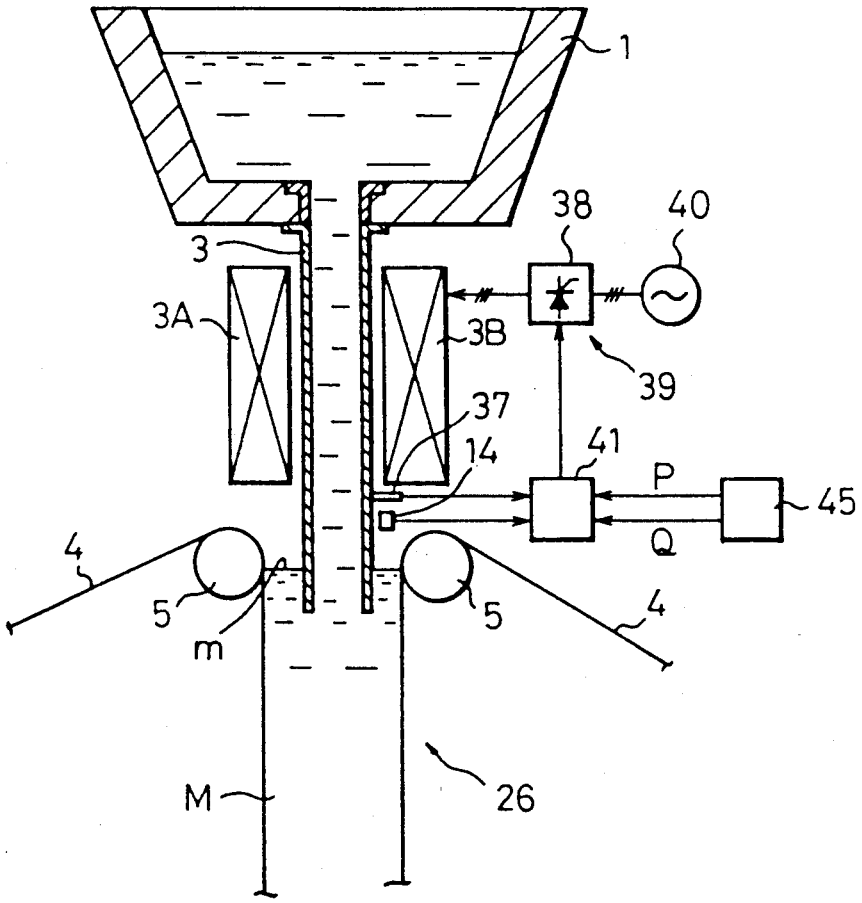
FIG. 17 is a diagram representing a seventh embodiment of the injection apparatus according to the present invention.

FIG. 17 is a diagram representing a seventh embodiment of injection unit according to the present invention. This unit has a construction similar to the unit shown in FIG. 15. However, the values P and Q are not calculated using the aforementioned equations (8) and (9), but are input from a data terminal 45.

Problems in introducing the linear motors, measures against the problems, and the method of the embodiment have been described, thus far. Next, the present invention will be clearly described using a simulation technique to show how effective the control with the linear motors is compared to a conventional sliding nozzle (SN) as a molten metal control means. The block diagram of the control system shown in FIG. 16 is used to explain the simulation, the dynamic behavior of the active end is approximated by dead time plus first-order lag, and the values in the table below are used as concrete value.

| | SN | linear motor nozzle |
|---|---|---|
| dead time (Td) [sec] | 0.3 | 0.01 |
| time constant (Ts) [sec] | 0.8 | 0.2 |

Thus, there is large difference between the linear motor and the nozzle in terms of response fine.

Figure 18:
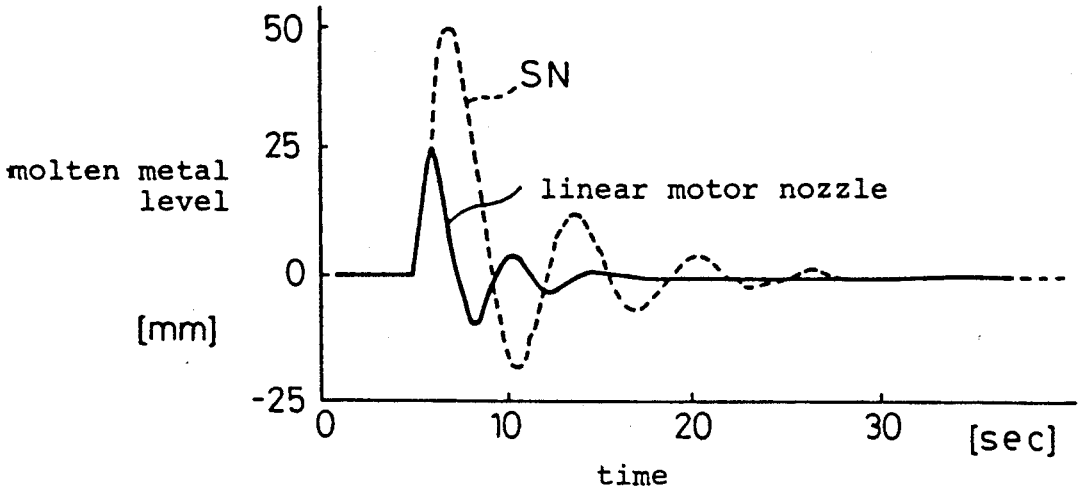
FIG. 18 is a diagram representing response in control by a linear motor and in control by a sliding nozzle.
Figure 19:
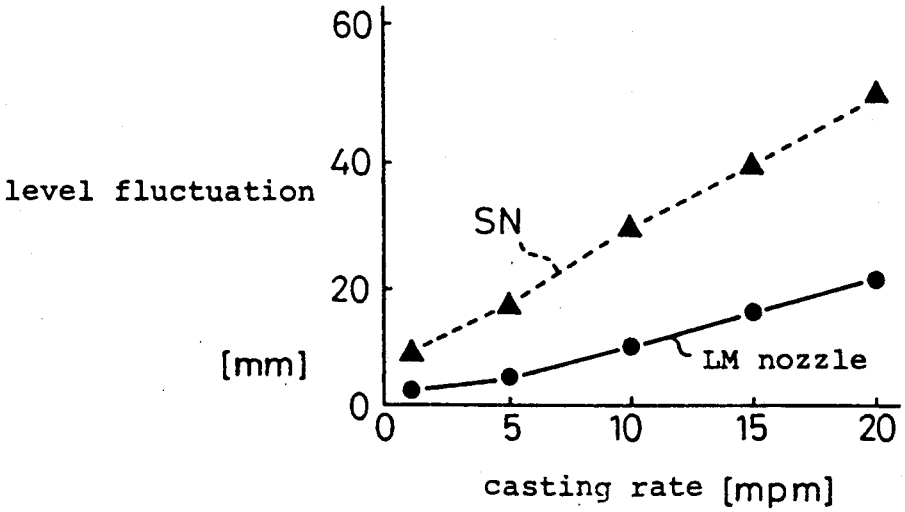
FIG. 19 is a diagram representing response at a various casting rates.

FIG. 18 shows a simulation result of the molten metal level fluctuation state caused by a disturbance in a casting rate 20 mpm, as a typical example. FIG. 19 similarly show ranges of the level fluctuation at different casting rates. Thus, the range of the level fluctuation can be narrowed to less than ½ by use of the linear motor when comparing the SN.

Since the fluctuation range of the molten metal level is one of the most important factors in the design of a thin plate continuous casting machine, it is obvious that injection control using the linear motor becomes more useful as the casting rate becomes higher.

Finally, FIG. 20 shows experimental data which confirms the characteristics of the linear motor in the case where molten steel is injected and controlled using a linear motor having a power factor improvement capacitor. This experiment was carried out according to the condition of the lower-frequency power, excluding the higher-frequency power condition, from the technical specifications of the continuous casting machine shown in FIG. 8.

FIG. 20 is a diagram representing an experimental result of flow rate control using the injection unit according to the present invention. In this figure, an obliquely extending curve represents the result from calculation, and marks X represent experimental results. Referring to FIG. 20, it is confirmed that there is a fixed relationship close to the calculated value between the output power of the linear motor and the flow rate.

According to FIG. 20, it is confirmed that the injection rate of the molten steel is varied roughly linearly when an acting force (proportional to the square of the current) or the current value is varied keeping the frequency constant, as characteristics of the linear motor comprising the power factor improvement capacitor.

The nozzle used in the experiment was damaged by electromagnetic force at more than 36 kgf of the output power of the linear motor so that measurement could no longer be carried out. Thus, there is trade-off relationship between the width of the control range and the strength of the nozzle. Therefore, the control range of the linear motor and the strength of the nozzle must be carefully designed depending on the purpose of the design of the actual equipment. In this case, use of the control with the linear motor and the control of the sliding nozzle or the stopper together is a practical and effective design.

The present invention solves practical problems when the linear motor unit is employed in the injection unit of a thin plate continuous casting machine, by arranging a pair of linear motors to face wide surfaces of the flat nozzle and by employing a power factor improvement capacitor.

According to the present invention, fast response injection control is realized by introducing a linear motor which can have a small power consumption by elevating its efficiency. From the result of the fluctuation range was less than ½ that of the conventional method and the effect becomes larger as the casting rate becomes higher.

Additionally, the efficiency of the linear motor is additionally elevated and distribution of the electromagnetic force along the width of the injection nozzle is uniform, so that the linear motor has an even smaller power consumption. The yield of the products is improved, damage of the nozzle is prevented, and blocking of the nozzle is suppressed by heating the nozzle and/or molten steel with the linear motor, so that a continuous casting is realized.

We claim:

1. An injection apparatus in a high-speed type thin plate continuous casting machine wherein a molten metal (2) is injected into a casting mold from a tundish (1) through a flat nozzle (3) having Y-direction long sides wider than X-direction short sides, and elongated along a Z-direction, characterized in that the injection apparatus comprises:

linear motors (3A, 3B), between which the long sides of said flat nozzle (3) are interposed for generating an electromagnetic feed force in the Z-direction along said long sides;

a power source unit (24) for applying predetermined voltages or currents having a predetermined frequency to said linear motors (3A, 3B), to cause said linear motors (3A, 3B) to generate said electromagnetic feed force; and linear motor power factor improving capacitors (21) connected to an electric line between said power source unit (24) and said linear motors (3A, 3B).

2. An injection apparatus as claimed in claim 1, comprising power control means (23, 25) inserted between said power source unit (24) and said linear motors (3A, 3B), for controlling at least one of the voltages and currents supplied to said linear motors (3A, 3B) to control a Z-direction acceleration/deceleration force acting on the molten metal (2) in said flat nozzle (3).

3. An injection apparatus as claimed in claim 2, comprising phase switching means (22, 27) inserted between said power source unit (24) and said linear motors (3A, 3B) for switching the phase of the power supplied to said linear motors (3A, 3B) to switch between positive and negative directions of the electromagnetic feed force of said linear motors (3A, 3B).

4. An injection apparatus as claimed in claim 1, wherein short side inner walls of said flat nozzle (3) essentially consist of a conductive material which is durable against said molten metal (2).

5. An injection apparatus as claimed in claim 2, wherein short side inner walls of said flat nozzle (3) essentially consist of a conductive material which is durable against said molten metal (2).

6. An injection apparatus as claimed in claim 3, wherein short side inner walls of said flat nozzle (3) essentially consist of a conductive material which is durable against said molten metal (2).

7. An injection apparatus as claimed in claim 4 wherein said conductive material is $ZrB_2$ or carbon.

8. An injection apparatus as claimed in claim 5 wherein said conductive material is $ZrB_2$ or carbon.

9. An injection apparatus as claimed in claim 6 wherein said conductive material is $ZrB_2$ or carbon.

10. An injection apparatus as claimed in claim 1, wherein said casting mold is a flat casting mold having at least a pair of endless casting belts (4) wound around upstream rollers (5) and downstream rollers (5') so as to oppose each other, and lower end portions of said linear motors (3A, 3B) extend below upper ends of said upstream rollers (5).

11. An injection apparatus as claimed in claim 2, wherein said casting mold is a flat casting mold having at least a pair of endless casting belts (4) wound around upstream rollers (5) and downstream rollers (5') so as to oppose each other, and lower end portions of said linear motors (3A, 3B) extend below upper ends of said upstream rollers (5).

12. An injection apparatus as claimed in claim 3, wherein said casting mold is a flat casting mold having at least a pair of endless casting belts (4) wound around upstream rollers (5) and downstream rollers (5') so as to oppose each other, and lower end portions of said linear motors (3A, 3B) extend below upper ends of said upstream rollers (5).

13. An injection apparatus as claimed in claim 2, comprising:

level detecting means (14) for detecting a molten metal level in a casting mold, and a control unit (30) for controlling said power control means (23, 25) depending on a difference between a signal from said detecting means (14) and a target molten metal level.

14. An injection apparatus as claimed in claim 13, wherein the injection apparatus comprises a stopper unit (15) provided in said tundish (1) and above said flat nozzle (3) for controlling an injection rate of the molten metal by being moved up or down, and said control unit (30) controls said power control means (23, 25) when said difference is smaller than a predetermined value and controls said stopper unit (15) when said difference is larger than the predetermined value.

15. An injection apparatus as claimed in claim 13, wherein said injection apparatus comprises a sliding nozzle provided in the middle of said flat nozzle (3) for controlling an injection rate of the molten metal by being opened or closed, and said control unit (30) controls said power control means (23, 25) when said difference is smaller than a predetermined value and controls said sliding nozzle when said difference is larger than the predetermined value.

16. An injection apparatus as claimed in claim 13, wherein said level detecting means (14).comprises an industrial television camera for picking up an image of a casting mold inner wall around a target position of the molten metal level, and a signal processing unit for detecting a position of the molten metal level from the image picked up by the industrial television camera and converting into a molten metal level signal.

17. An injection apparatus as claimed in claim 14, wherein said level, detecting means (14) comprises an industrial television camera (28) for picking up an image of a casting mold inner wall around a target position of the molten metal level, and a signal processing unit (29) for detecting a position of the molten metal level from the image picked up by the industrial television camera (28) and converting into a molten metal level signal.

18. An injection apparatus as claimed in claim 15, wherein said level detecting means (14) comprising an industrial television camera (28) for picking up an image of a casting mold inner wall around a target position of the molten metal level, and a signal processing unit (29) for detecting a position of the molten metal level from the image picked up by the industrial television camera (28) and converting into a molten metal level signal.

19. An injection apparatus as claimed in claim 13, comprising:

an input unit to which a heat quantity Q supplied to the molten steel by said linear motors (3A, 3B) and a force P from said linear motors (3A, 3B) acting on the molten steel are input, a calculation unit calculating a frequency f and a current i using formulas $$f=K_1(Q/P)$$

and $$i = K_2(\sqrt{P^2/Q}),$$

wherein $K_1$ and $K_2$ are constants, and a power converting unit converting a commercial power to a power having a frequency f and a current i according to the output of said calculation unit and supplying the power to the linear motors (3A, 3B).

20. An injection apparatus as claimed in claim 13, comprising:

a temperature detecting means (37) for detecting a temperature of the molten steel, a calculation unit for calculating a heat quantity Q supplied to the molten steel by the linear motors (3A, 3B) and a force P from said linear motors (3A, 3B) acting on the molten steel from the signal of said temperature detecting means, and further calculating a frequency f and a current i using formulas $$f=K_1(Q/P)$$

and $$i = K_2 (\sqrt{P^2/Q}),$$

wherein $K_1$ and $K_2$ are constants, and a power converting unit converting a commercial power to a power having a frequency f and a current i according to the output of said calculation unit and supplying the power to the linear motors (3A, 3B).

21. An injection apparatus as claimed in claim 13, wherein said power source unit supplies a power formed by superimposing a plurality of frequency bands having frequencies different from each other to said linear motors (3A, 3B).

22. An injection apparatus as claimed in claim 13, wherein said power source unit comprises a plurality of power supply units having frequencies different from each other and a switching unit for switching them.

23. An injection apparatus as claimed in claim 21, wherein at least one of said plurality of frequency bands is within a lower frequency range of 30 to 3000 Hz and at least another one of said plurality of frequency bands is within a higher frequency range of 3 to 450 kHz.

24. An injection apparatus as claimed in claim 22, wherein a frequency band in at least one of said plurality of power supply units is within a lower frequency range of 30 to 3000 Hz and a frequency band in at least another one of said plurality of power supply units is within a high frequency range of 3 to 450 kHz.

25. An injection control method for a high-speed type thin plate continuous casting machine wherein a molten metal (2) is injected into a casting mold from a tundish (1) through a flat nozzle (3) having Y-direction long sides wider than X-direction short sides, and elongated along a Z-direction, comprising the steps of:

providing linear motors (3A, 3B) between which the long sides of said flat nozzle (3) are interposed for generating an electromagnetic feed force in a Z-direction along said long sides;

providing a power source unit (24) for applying predetermined voltages or currents having a predetermined frequency to said linear motors (3A, 3B), to cause said linear motors (3A, 3B) to generate said electromagnetic feed force;

providing linear motor power factor improving capacitors (21) connected to an electric line between said power source unit (24) and said linear motors (3A, 3B);

and controlling at least one of the voltages and currents supplied to said linear motors (3A, 3B) to control a Z-direction acceleration/deceleration force acting on the molten metal (2) in said flat nozzle (3).

26. A method as claimed in claim 25, wherein the method further comprises the steps of detecting a molten metal level in the casting mold, and in said controlling step, at least one of the voltages and currents are controlled depending on a difference between the detected level and a target molten metal level.

27. A method as claimed in claim 26, wherein the method further comprises the steps of:

providing a stopper unit (15) above said flat nozzle (3) in said tundish (1) for controlling an injection rate of the molten level by being moved up or down; and interrupting said controlling step and controlling said stopper unit (15) depending on said difference, while the difference is larger than a predetermined level.

28. A method as claimed in claim 26, wherein the method further comprises the steps of:

providing a sliding nozzle in the middle of said flat nozzle (3) for controlling an injection rate of the molten metal by being opened or closed; and interrupting said controlling step and controlling said sliding nozzle depending on said difference, while the difference is larger than a predetermined level.

29. A method as claimed in claim 25, wherein the method further comprises the steps of:

detecting a molten metal level in the casting mold;

detecting a temperature of the molten metal;

calculating a heat quantity Q supplied to the molten steel by the linear motors (3A, 3B) and a force P from said linear motors (3A,3B) acting on the molten steel, from said detected level and temperature; and calculating frequency f and a current i using formulas $$f = k_1 (Q/P)$$

and $$i = k_2 (\sqrt{P^2/Q})$$

wherein $k_1$ and $k_2$ are constants, and in said controlling step, a commercial power is converted to a power having a frequency f and a current i and supplied to the linear motors (3A, 3B).

* * * * *

UNITED STATES PATENT AND TRADEMARK OFFICE

CERTIFICATE OF CORRECTION

PATENT NO. : 5,027,885

DATED : July 2, 1991

INVENTOR(S) : Keisuke FUJISAKE, et al.

It is certified that error appears in the above-identified patent and that said Letters Patent is hereby corrected as shown below:

Column 3, line 45, after "heating" insert a period.

Column 3, line 67, after "later" insert a period.

Column 4, line 31, change "o" to --of--.

Column 20, line 30, before "fluctua-" insert --simulation, the width of the molten metal level--.

Column 22, line 16, delete the comma after "level".

Column 24, line 7, change "steps" to --step--.

Signed and Sealed this

Fourteenth Day of December, 1993

Bruce Lehman

*Attest:*

BRUCE LEHMAN

*Attesting Officer*

*Commissioner of Patents and Trademarks*